US011149410B2

(12) United States Patent
Kumagai et al.

(10) Patent No.: US 11,149,410 B2
(45) Date of Patent: Oct. 19, 2021

(54) WORK MACHINE WITH AUTOMATIC AND MANUAL OPERATING CONTROL

(71) Applicant: Hitachi Construction Machinery Co., Ltd., Tokyo (JP)

(72) Inventors: Kento Kumagai, Ami-Machi (JP); Shinya Imura, Toride (JP); Genroku Sugiyama, Ryuugasaki (JP); Katsuaki Kodaka, Tsukuba (JP); Yasutaka Tsuruga, Ryuugasaki (JP); Takaaki Chiba, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 17/252,129

(22) PCT Filed: Mar. 28, 2019

(86) PCT No.: PCT/JP2019/013839

§ 371 (c)(1),
(2) Date: Dec. 14, 2020

(87) PCT Pub. No.: WO2020/194732

PCT Pub. Date: Oct. 1, 2020

(65) Prior Publication Data

US 2021/0254309 A1 Aug. 19, 2021

(51) Int. Cl.
*E02F 9/22* (2006.01)

(52) U.S. Cl.
CPC ..... *E02F 9/2228* (2013.01); *E02F 9/2267* (2013.01); *E02F 9/2285* (2013.01)

(58) Field of Classification Search
CPC ... F15B 2211/63; E02F 9/2228; E02F 9/2285; E02F 9/2267
See application file for complete search history.

(56) References Cited

U.S. PATENT DOCUMENTS 5,446,981 A * 9/1995 Kamada ..... E02F 3/437 172/2
5,673,558 A * 10/1997 Sugiyama ..... E02F 9/2228 60/426

(Continued)

FOREIGN PATENT DOCUMENTS

JP 6-159309 A 6/1994
JP 8-13547 A 1/1996

(Continued)

OTHER PUBLICATIONS

International Search Report (PCT/ISA/210) issued in PCT Application No. PCT/JP2019/013839 dated May 21, 2019 with English translation (four (4) pages).

(Continued)

*Primary Examiner* — Thomas E Lazo
(74) *Attorney, Agent, or Firm* — Crowell & Moring LLP

(57) ABSTRACT

A work machine capable of driving each actuator more speedily and more accurately by ensuring high operability in a case of operator's manual operation, while accurately supplying a hydraulic fluid at a target flow rate to the actuator without depending on a load fluctuation in a case of automatic control over a machine body in response to a command input from a controller is provided. The controller controls a plurality of auxiliary flow controllers in such a manner that supply flow rates to a plurality of directional control valves from hydraulic pumps either fluctuate in response to load fluctuations of a plurality of hydraulic actuators when an area limiting control function invalidation instruction is issued, or do not fluctuate in response to the load fluctuations of the plurality of hydraulic actuators when an area limiting control function validation instruction is issued.

7 Claims, 17 Drawing Sheets

(56) References Cited

U.S. PATENT DOCUMENTS

| | | | | |
|---|---|---|---|---|
| 5,752,333 | A * | 5/1998 | Nakagawa | E02F 3/437 37/348 |
| 5,835,874 | A * | 11/1998 | Hirata | E02F 3/435 701/50 |
| 7,949,449 | B2 * | 5/2011 | Koch | E02F 9/265 701/50 |
| 9,382,693 | B2 * | 7/2016 | Yamada | F15B 11/10 |
| 9,441,348 | B1 * | 9/2016 | Alig | E02F 3/431 |
| 9,556,583 | B2 * | 1/2017 | Guo | E02F 9/2025 |
| 9,725,874 | B2 * | 8/2017 | Meguriya | E02F 9/2004 |
| 2009/0159302 | A1 | 6/2009 | Koch et al. | |
| 2018/0202130 | A1 * | 7/2018 | Morimoto | E02F 9/2004 |

FOREIGN PATENT DOCUMENTS

| | | | |
|---|---|---|---|
| JP | 3056254 | B2 | 6/2000 |
| JP | 3564911 | B2 | 9/2004 |
| JP | 2005-121155 | A | 5/2005 |
| JP | 2016-61387 | A | 4/2016 |
| JP | 2018-80510 | A | 5/2018 |
| JP | 2018080510 | A * | 5/2018 |

OTHER PUBLICATIONS

Japanese-language Written Opinion (PCT/ISA/237) issued in PCT Application No. PCT/JP2019/013839 dated May 21, 2019 (four (4) pages).

* cited by examiner

FIG. 10A $$\beta_{BOOM} = \gamma_{BOOM} \times \alpha$$
$$\beta_{ARM} = \gamma_{ARM} \times \alpha$$
$$\beta_{BUCKET} = \gamma_{BUCKET} \times \alpha$$
$$\beta_{SWING} = \gamma_{SWING} \times \alpha$$

$\gamma$ : CORRECTION COEFFICIENT SET PER ACTUATOR

WORK MACHINE WITH AUTOMATIC AND MANUAL OPERATING CONTROL

TECHNICAL FIELD

The present invention relates to a work machine such as a hydraulic excavator.

BACKGROUND ART

A work machine such as a hydraulic excavator includes a machine body including a swing structure, and a work device (front device) attached to the swing structure, and the work device includes a boom (front member) connected to the swing structure vertically rotatably, an arm (front member) connected to a tip end of this boom vertically rotatably, an arm (front member) connected to a tip end of this boom vertically rotatably, a bucket (front member) connected to a tip end of this arm vertically rotatably, a boom cylinder (actuator) that drives the boom, an arm cylinder (actuator) that drives the arm, and a bucket cylinder (actuator) that drives the bucket. It is not easy to operate the front members of the work machine by corresponding manual operation levers to excavate a predetermined area, so that an operator is required to have expertise of operation. To meet the requirement, technologies for facilitating such work are proposed (Patent Documents 1 and 2).

An area limiting excavation control device for a construction machine described in Patent Document 1 includes: controller including detection means that detects a position of a front device, a computing section that computes the position of the front device from a signal from this detection means, a setting section that sets an entry prohibited area where an entry of the front device is prohibited, and a computing section that calculates a control gain of an operation lever signal from the entry prohibited area and the position of the front device; and actuator control means that controls operations of actuators from the calculated control gain. According to such a configuration, a lever operation signal is controlled in response to a distance to a demarcation line of the entry prohibited area; thus, control is exercised in such a manner that a trajectory of a bucket tip end moves automatically along a demarcation even when an operator falsely intends to move the bucket tip end to the entry prohibited area. It is thereby possible for any operator to conduct stable work with high precision without depending on operator's expertise of operation.

Meanwhile, in a hydraulic drive system described in Patent Document 2, a pressure compensating valve compensating for a pressure of a directional control valve of each actuator is disposed in series in the directional control valve. Accordingly, an operator can supply a hydraulic fluid at a flow rate in response to a lever operation amount to each actuator without influence of a load fluctuation. Furthermore, a target compensation differential pressure of the pressure compensating valve is changed in a case in which a pump is incapable of delivering a hydraulic fluid at a pump delivery flow rate equal to a target flow rate due to horsepower control or the like, whereby it is possible to supply the hydraulic fluid while the flow rate of the hydraulic fluid delivered to each actuator is reduced and a flow rate allocation ratio of the hydraulic fluid is kept. Moreover, by setting so-called downward-sloping characteristics indicating a degree of reducing the flow rate at each pressure compensating valve in response to an increase in a load pressure of the corresponding actuator itself, it is possible to impart the downward-sloping characteristics to the actuator to prevent occurrence of hunting in response to load characteristics of the actuator and to improve stability of an operation of the actuator.

PRIOR ART DOCUMENT

Patent Document

Patent Document 1: JP 3056254
Patent Document 2: JP 3564911

SUMMARY OF THE INVENTION

Problem to be Solved by the Invention

The construction machine described in Patent Document 1 has the following problems in a case of supposing changeover between an operator's manual operation function and a machine body automatic control function in response to a work content.

In a case of the machine body automatic control in response to a command from the controller, it is important to accurately move the tip end of the front device along a target trajectory, and it is necessary to accurately supply the hydraulic fluid at the target flow rate to each actuator for accurately moving the tip end thereof. However, in the area limiting excavation control device described in Patent Document 1, it is an opening amount of each directional control valve that is controlled in response to the lever operation amount; thus, the hydraulic fluid at the flow rate may be unstably supplied to the actuator depending on a change in a differential pressure across the valve in association with a load fluctuation of the actuator, in some cases.

In contrast, with the technology of Patent Document 2, controlling not only the opening amount of each directional control valve in response to an operation lever input amount but also the differential pressure across the directional control valve by the pressure compensating valve enables accurate supply of the hydraulic fluid at the flow rate to the actuator without depending on the load of the actuator. Accordingly, it is considered that applying the technology of Patent Document 2 to the area limiting excavation control device of Patent Document 1 makes it possible to accurately deliver the hydraulic fluid at the target flow rate to each actuator without depending on the load fluctuation even under automatic control.

However, the change in the operation of the actuator depending on the load fluctuation is one important information for determination in operator's operating the machine body via the operation lever. To implement a function capable of accurately delivering the hydraulic fluid at the target flow rate to each actuator without depending on the load fluctuation as described above means a loss of the change in the operation of the actuator in association with the load fluctuation. Owing to this, the operator possibly has a strong sense of incongruity in a feeling of operating the machine body, which disadvantageously causes degradation in operability of the machine body.

In this way, the operator's manual operation function and the machine body automatic control function of the work machine such as a hydraulic excavator differ from each other in intended performance and also differ from each other in a hydraulic system configuration suited to the intended performance for these functions. Owing to this, even when one hydraulic system of the work machine is capable of changeover between these two functions, it is difficult to achieve the performances intended for those functions.

The present invention has been achieved in light of these circumstances, and an object of the present invention is to provide a work machine capable of driving each actuator more speedily and more accurately by ensuring high operability in a case of operator's manual operation, while accurately supplying a hydraulic fluid at a target flow rate to the actuator without depending on a load fluctuation in a case of automatic control over a machine body in response to a command input from a controller.

Means for Solving the Problem

To attain the object, a work machine according to the present invention includes: a travel structure; a swing structure swingably attached onto the travel structure; a work device attached to the swing structure; a plurality of hydraulic actuators driving the swing structure or the work device; hydraulic pumps; regulators exercising horsepower control over the hydraulic pumps in response to load pressures of the plurality of hydraulic actuators; a plurality of directional control valves connected to delivery lines of the hydraulic pumps in parallel and regulating supply flow rates to the plurality of hydraulic actuators from the hydraulic pumps; operation lever devices for issuing instructions on operations of the plurality of hydraulic actuators; a pilot pump; operation pressure generation valve devices reducing a delivery pressure of the pilot pump in response to operation instruction amounts from the operation lever devices, and outputting the reduced delivery pressure as operation pressures of the plurality of directional control valves; a control validation switch for issuing an instruction to validate or invalidate an area limiting control function to prevent entry of the work device into a preset area; and a controller that controls the operation pressure generation valve devices in such a manner as to output the operation pressures in response to the operation instruction amounts from the operation lever devices in a case in which the control validation switch issues an instruction to invalidate the area limiting control function, and that controls the operation pressure generation valve devices in such a manner as to correct the operation pressures in response to the operation instruction amounts from the operation lever devices and to output the corrected operation pressures in a case in which the control validation switch issues an instruction to validate the area limiting control function. The work machine includes a plurality of auxiliary flow controllers that are connected to upstream of the plurality of directional control valves and that can limit supply flow rates to the plurality of directional control valves from the hydraulic pumps. The controller, in the case in which the control validation switch issues an instruction to invalidate the area limiting control function, controls the plurality of auxiliary flow controllers in such a manner that the supply flow rates to the plurality of directional control valves from the hydraulic pumps fluctuate in response to load fluctuations of the plurality of hydraulic actuators; and in the case in which the control validation switch issues an instruction to validate the area limiting control function, controls the plurality of auxiliary flow controllers in such a manner that the supply flow rates to the plurality of directional control valves from the hydraulic pumps do not fluctuate in response to the load fluctuations of the plurality of hydraulic actuators, and controls the plurality of auxiliary flow controllers in such a manner that the supply flow rates to the plurality of directional control valves from the hydraulic pumps are reduced in response to a pump flow rate reduction rate that is a ratio of a current delivery flow rate of each of the hydraulic pumps to a target delivery flow rate of each of the hydraulic pumps at a time of occurrence of saturation indicating that the current delivery flow rate of each of the hydraulic pumps is reduced to be lower than the target delivery flow rate of each of the hydraulic pumps due to the horsepower control.

According to the present invention configured as described so far, in the case in which the area limiting control function is invalid, then the flow control of the auxiliary flow controllers is made invalid, and the auxiliary flow controllers maintain openings in response to the operator's operation input amounts and split a flow for the plurality of hydraulic actuators. In this case, the operator is more sensitive to the change in each actuator operation in response to the load fluctuation of the actuator; thus, it is possible to ensure operability of the work machine at the time of the operator's operation. On the other hand, in the case in which the area limiting control function is valid, the auxiliary flow controllers can supply the hydraulic fluid at the flow rate agreeable to the target flow rate commanded by the controller to each actuator without depending on the load fluctuation of the actuator with high responsiveness and with stability; thus, it is possible to improve automatic control accuracy of the actuator. As described so far, changing over to hydraulic system characteristics suited for each of two types of operation modes, that is, an operation mode during the operator's manual operation and an operation mode during the automatic control by the controller makes it possible to ensure demanded performances in the two operation modes.

Advantages of the Invention

The work machine according to the present invention can drive each actuator more speedily and more accurately by ensuring high operability in the case of the operator's manual operation, while accurately supplying the hydraulic fluid at the target flow rate to the actuator without depending on the load fluctuation in the case of automatic control over the machine body in response to a command input from the controller.

BRIEF DESCRIPTION OF THE DRAWINGS

FIG. 10A is a diagram depicting an example of a flow rate correction ratio according to Embodiment 3 of the present invention.

MODES FOR CARRYING OUT THE INVENTION

Figure 1:
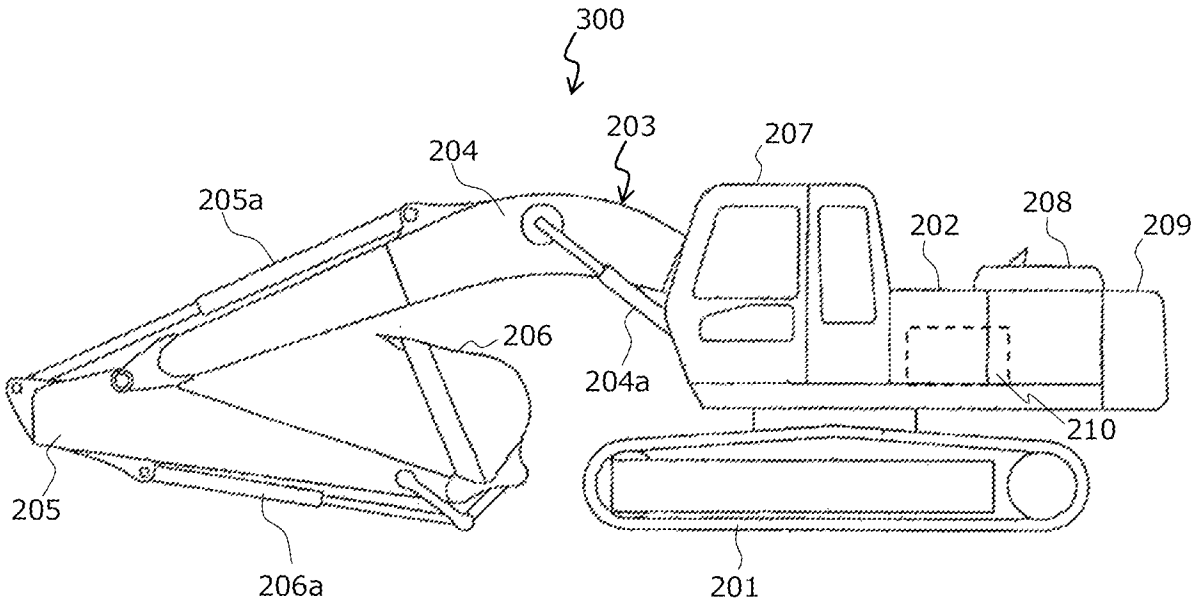
FIG. 1 is a side view of a hydraulic excavator according to embodiments of the present invention.

A hydraulic excavator will be described hereinafter as an example of a work machine according to embodiments of the present invention with reference to the drawings. It is noted that equivalent members are denoted by same reference characters in the drawings and that repetitive description will be omitted.

FIG. 1 is a side view of a hydraulic excavator according to the present embodiments.

As depicted in FIG. 1, a hydraulic excavator 300 includes a travel structure 201, a swing structure 202 disposed on this travel structure 201 and configuring a machine body, and a work device 203 attached to this swing structure 202 and conducting earth and sand excavation work and the like.

The work device 203 includes a boom 204 vertically rotatably attached to the swing structure 202, an arm 205 vertically rotatably attached to a tip end of the boom 204, a bucket 206 vertically rotatably attached to a tip end of the arm 205, a boom cylinder 204*a* driving the boom 204, an arm cylinder 205*a* driving the arm 205, and a bucket cylinder 206*a* driving the bucket 206.

A cabin 207 is provided at a front side position on the swing structure 202, and a counterweight 209 that keeps weight balance is provided at a rear side position. A machine room 208 accommodating therein an engine, a hydraulic pump, and the like is provided between the cabin 207 and the counterweight 209, and a control valve 210 is installed in the machine room 208.

A hydraulic drive system to be described in the following embodiments is mounted in the hydraulic excavator 300 according to the present embodiments.

Embodiment 1

Figure 2A:
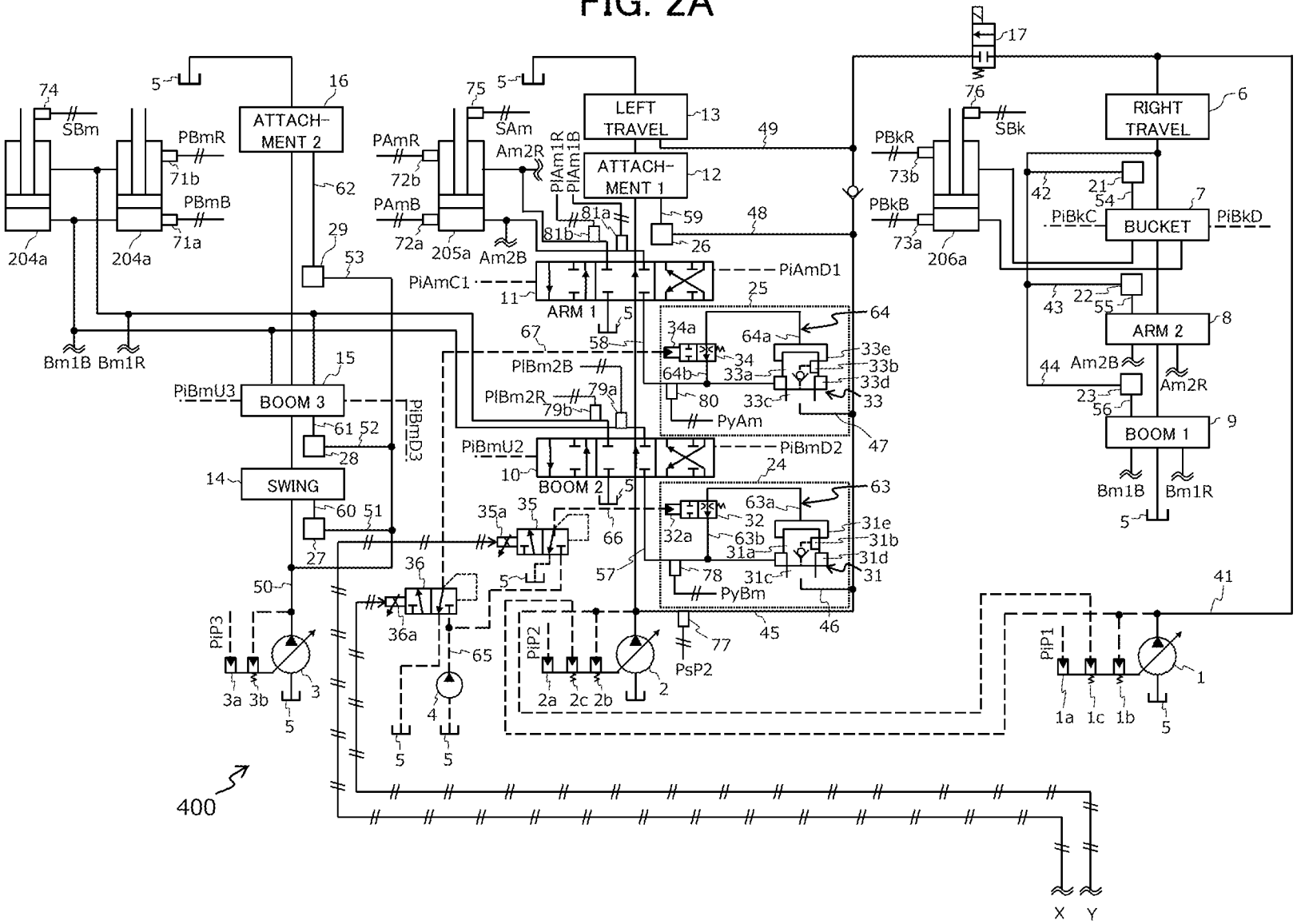
FIG. 2A is a circuit diagram (1/2) of a hydraulic drive system according to Embodiment 1 of the present invention.
Figure 2B:
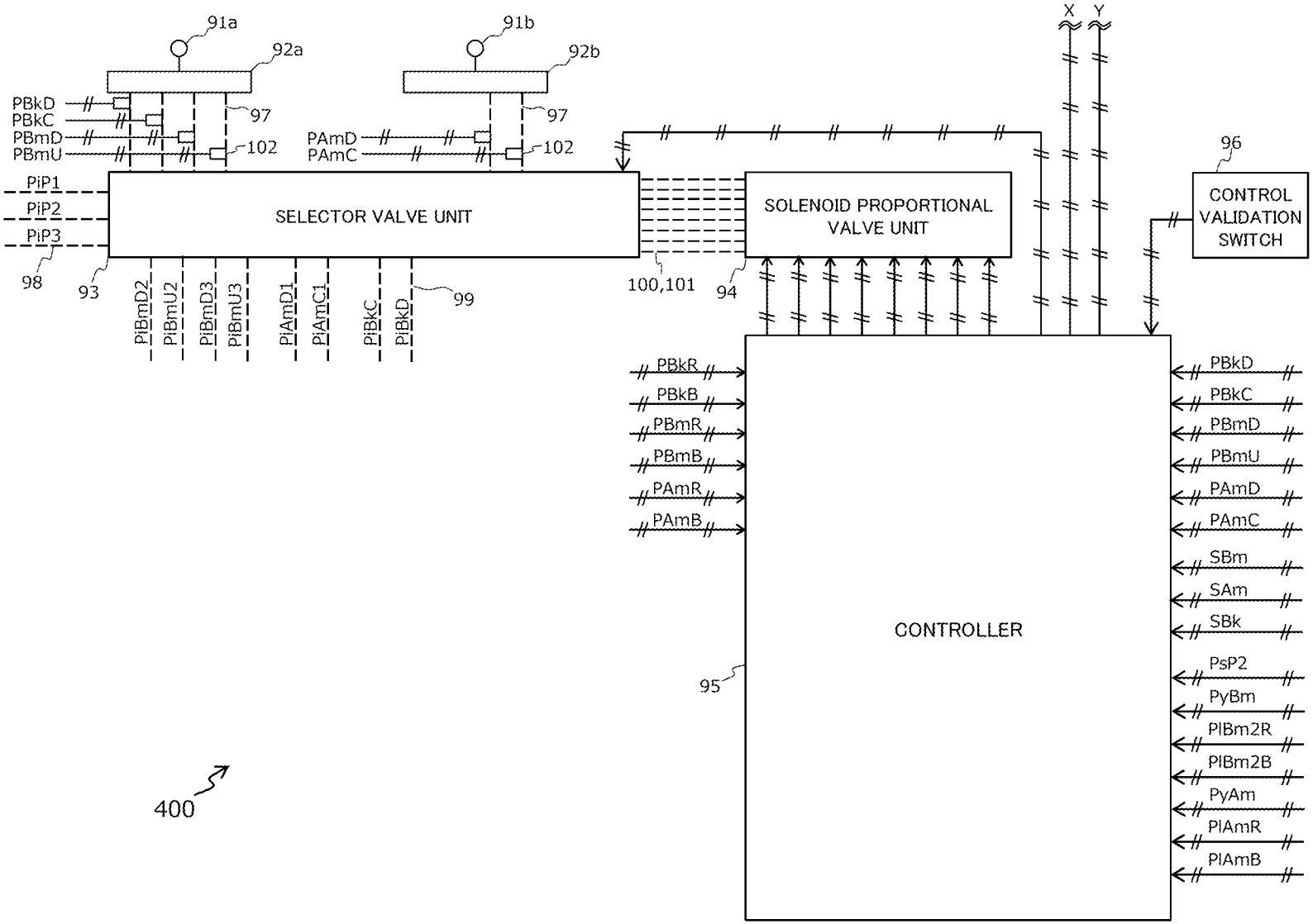
FIG. 2B is a circuit diagram (2/2) of the hydraulic drive system according to Embodiment 1 of the present invention.

FIGS. 2A and 2B are circuit diagrams of the hydraulic drive system according to Embodiment 1 of the present invention.

(1) Configuration

As depicted in FIGS. 2A and 2B, a hydraulic drive system 400 according to Embodiment 1 includes three main hydraulic pumps, for example, a first hydraulic pump 1, a second hydraulic pump 2, and a third hydraulic pump 3 each formed from, for example, a variable displacement hydraulic pump, which are driven by the engine that is not depicted. In addition, the hydraulic drive system 400 includes a pilot pump 4 driven by the engine that is not depicted, and a hydraulic operating fluid tank 5 that supplies hydraulic operating fluids to the first to third hydraulic pumps 1, 2, and 3, and the pilot pump 4.

A tilting angle of the first hydraulic pump 1 is controlled by a regulator attached to this first hydraulic pump 1. The regulator of this first hydraulic pump 1 includes a flow control command pressure port 1*a*, a first hydraulic pump self-pressure port 1*b*, a second hydraulic pump self-pressure port 1*c*. Likewise, a tilting angle of the second hydraulic pump 2 is controlled by a regulator attached to this second hydraulic pump 2. The regulator of this second hydraulic pump 2 includes a flow control command pressure port 2*a*, a second hydraulic pump self-pressure port 2*b*, a first hydraulic pump self-pressure port 2*c*. Furthermore, likewise, a tilting angle of the third hydraulic pump 3 is controlled by a regulator attached to this third hydraulic pump 3. The regulator of this third hydraulic pump 3 includes a flow control command pressure port 3*a* and a third hydraulic pump self-pressure port 3*b*.

A right travel directional control valve 6 that controls a flow of a hydraulic fluid supplied to a right travel motor, which is not depicted, out of a pair of travel motors driving the travel structure 201 and that is provided most upstream is connected to the first hydraulic pump 1. A bucket directional control valve 7 that controls a flow of a hydraulic fluid supplied to the bucket cylinder 206*a*, a second arm directional control valve 8 that controls a flow of a hydraulic fluid supplied to the arm cylinder 205*a*, and a first boom directional control valve 9 that controls a flow of a hydraulic fluid supplied to the boom cylinder 204*a* are provided downstream of this right travel directional control valve 6 and connected to the first hydraulic pump 1. The bucket directional control valve 7, the second arm directional control valve 8, and the first boom directional control valve 9 are connected in parallel via a line 41 connected to the right travel directional control valve and connected to the line 41 via lines 42, 43, and 44.

A second boom directional control valve 10 that controls the flow of the hydraulic fluid supplied to the boom cylinder 204*a*, a first arm directional control valve 11 that controls the flow of the hydraulic fluid supplied to the arm cylinder 205*a*, a first attachment directional control valve 12 that controls a flow of a hydraulic fluid supplied to a first actuator that is not depicted and that drives, for example, a first special attachment such as a cut in-block machine provided as an alternative to the bucket 206, and a left travel directional control valve 13 that controls driving of a left travel motor that is not depicted out of the pair of travel motors driving the travel structure 201 are connected to the second hydraulic pump 2. The second boom directional control valve 10, the first arm directional control valve 11, the first attachment directional control valve 12, and the left travel directional control valve 13 are connected to each other in parallel via a line 45 connected to the second hydraulic pump 2 and are connected to the line 45 via lines 46, 47, 48, and 49. Furthermore, the line 49 is connected to the line 41 via a merging valve 17.

A swing directional control valve 14 that controls a flow of a hydraulic fluid supplied to a swing motor that is not depicted and that drives the swing structure 202, a third boom directional control valve 15 that controls the flow of the hydraulic fluid supplied to the boom cylinder 204*a*, and a second attachment directional control valve 16 that controls a flow of a hydraulic fluid supplied to a second actuator that is not depicted when a second special attachment configured with the second actuator is attached in addition to the first special attachment or when the second special attachment configured with the first actuator and the second actuator is attached as an alternative to the first special attachment are connected to the third hydraulic pump 3.

The swing directional control valve 14, the third boom directional control valve 15, and the second attachment directional control valve 16 are connected to each other in parallel via a line 50 connected to the third hydraulic pump 3 and are connected to this line 50 via lines 51, 52, and 53.

A pressure sensor 71*a* that detects a bottom-side pressure and a pressure sensor 71*b* that detects a rod-side pressure are provided at the boom cylinder 204*a*. Likewise, a pressure sensor 72*a* that detects a bottom-side pressure and a pressure sensor 72*b* that detects a rod-side pressure are provided at the arm cylinder 205*a*. Furthermore, likewise, a pressure sensor 73*a* that detects a bottom-side pressure and a pressure sensor 73*b* that detects a rod-side pressure are provided at the bucket cylinder 206*a*. Moreover, a stroke sensor 74 that detects an amount of strokes of the boom cylinder 204*a*, a stroke sensor 75 that detects an amount of strokes of the arm cylinder 205*a*, and a stroke sensor 76 that detects an amount of strokes of the bucket cylinder 206*a* are provided for the purpose of acquiring an operation state of the machine body. It is noted that type of means for acquiring the operation state of the machine body cover a broad range such as an inclination sensor, a rotational angle sensor, and an IMU, and are not limited to the stroke sensors described above.

Auxiliary flow controllers 21, 22, and 23 that limit flow rates of the hydraulic fluids supplied to the directional control valves from the first hydraulic pump 1 at a time of a combined operation are provided at the line 42 connected to the bucket directional control valve 7, the line 43 connected to the second arm directional control valve 8, and the line 44 connected to the first boom directional control valve 9, respectively.

Auxiliary flow controllers 24 and 25 that limit flow rates of the hydraulic fluids supplied to the directional control valves 10 and 11 from the second hydraulic pump 2 at the time of the combined operation are provided at the line 46 connected to the second boom directional control valve 10 and the line 47 connected to the first arm directional control valve 11, respectively. In Embodiment 1, the auxiliary flow controller 24 is configured with a sheet-shaped main valve 31 that forms an auxiliary variable throttle, a feedback throttle 31*b* that changes an opening area thereof in response to a movement amount of a valve body 31*a* of the main valve 31, that is provided at the valve body 31*a*, and that serves as a control variable throttle, and a hydraulic variable throttle valve 32 that serves as a pilot variable throttle. A housing incorporating therein the main valve 31 has a first pressure chamber 31*c* formed in a connection portion where the main valve 31 is connected to the line 46, a second pressure chamber 31*d* formed in a connection portion of a line 57 between the main valve 31 and the second boom directional control valve 10, and a third pressure chamber 31*e* formed in such a manner as to communicate with the first pressure chamber 31*c* via the feedback throttle 31*b*. The third pressure chamber 31*e* is connected to the hydraulic variable throttle valve 32 by a line 63*a*, the hydraulic variable throttle valve 32 is connected to the line 57 by a line 63*b*, and these lines 63*a* and 63*b* form a pilot line 63.

A pressure signal port 32*a* of the hydraulic variable throttle valve 32 is connected to an output port of a proportional solenoid pressure reducing valve 35, a supply port of the proportional solenoid pressure reducing valve 35 is connected to the pilot pump 4, and a tank port of the hydraulic variable throttle valve 32 is connected to the hydraulic operating fluid tank 5.

A pressure sensor 77 is provided at the line 45 connected to the second hydraulic pump. A pressure sensor 78 is provided at the line 57 connecting the second boom directional control valve 10 to the auxiliary flow controller 24. A pressure sensor 79*a* is provided at a line connecting the second boom directional control valve 10 to a bottom side of the boom cylinder 204*a*. A pressure sensor 79*b* is provided at a line connecting the second boom directional control valve 10 to a rod side of the boom cylinder 204*a*. A pressure sensor 80 is provided at a line 58 connecting the first arm directional control valve 11 to the auxiliary flow controller 25. A pressure sensor 81*a* is provided at a line connecting the first arm directional control valve 11 to a bottom side of the arm cylinder 205*a*. A pressure sensor 81*b* is provided at a line connecting the first arm directional control valve 11 to a rod side of the arm cylinder 205*a*.

While partial configurations are not depicted for the sake of simple description, auxiliary flow controllers 21 to 29 and surrounding instruments, lines, and interconnections are all identical in configuration to those described above.

This hydraulic drive system 400 according to Embodiment 1 is configured with an operation lever 91*a* and a pilot valve 92*a* that can change over positions of each of the first boom directional control valve 9, the second boom directional control valve 10, the third boom directional control valve 15, and the bucket directional control valve 7, and an operation lever 91*b* and a pilot valve 92*b* that can change over positions of each of the first arm directional control valve 11 and the second arm directional control valve 8. Pressure sensors 102 that detect that the boom 204, the arm 205, and the bucket 206 are operated are provided in lines 97 connecting the pilot valves 92*a* and 92*b* to a selector valve unit 93. It is noted that to avoid complicated description, a swing operation device that operates the swing directional control valve 14 to change over positions thereof, a right travel operation device that operates the right travel directional control valve 6 to change over positions thereof, a left travel operation device that operates the left travel directional control valve 13 to change over positions thereof, a first attachment operation device that operates the first attachment directional control valve 12 to change over positions thereof, and a second attachment operation device that operates the second attachment directional control valve 16 to change over positions thereof are not depicted.

The selector valve unit 93 is connected to the flow control command ports of the first to third hydraulic pumps 1, 2, and 3 via lines 98, connected to pilot ports of the directional control valves via lines 99, and connected to a solenoid proportional valve unit 94 via lines 100 and 101.

Figure 3:
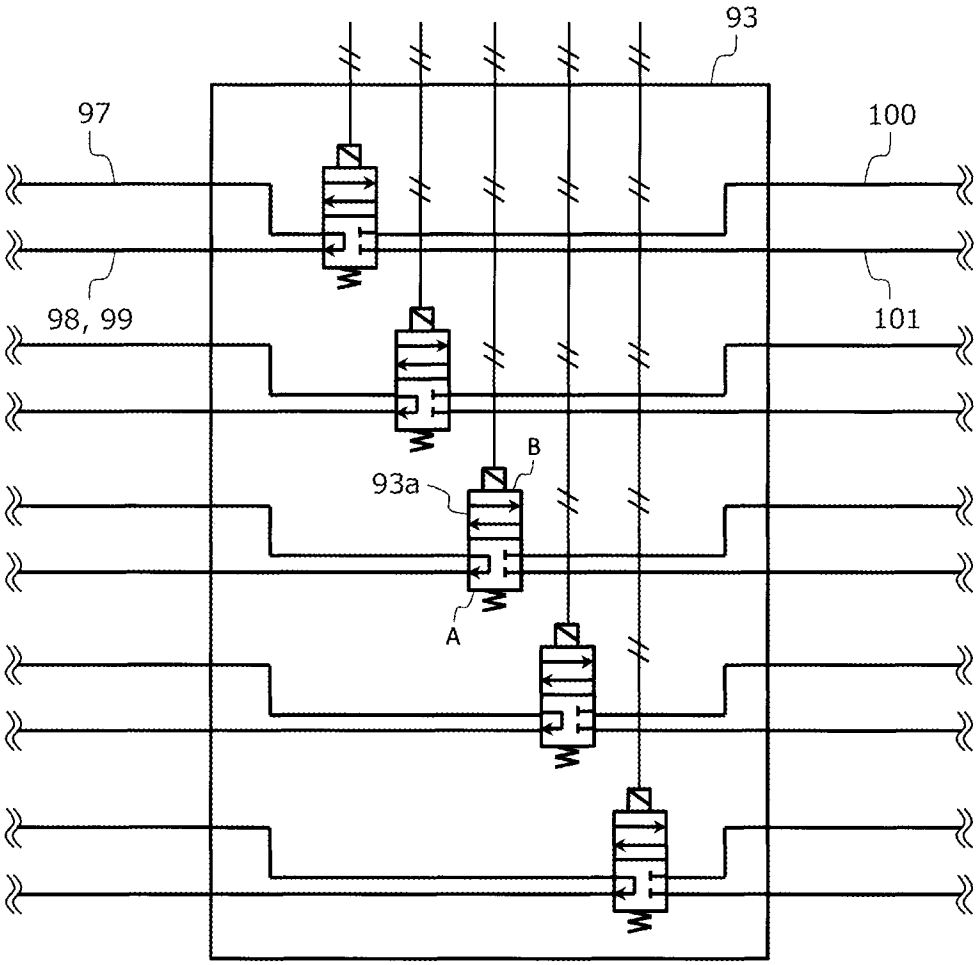
FIG. 3 is a configuration diagram of a selector valve unit according to Embodiment 1 of the present invention.

FIG. 3 is a configuration diagram of the selector valve unit 93. As depicted in FIG. 3, the selector valve unit 93 incorporates therein a plurality of solenoid selector valves 93*a* subjected to position control by a command from a controller 95. A position of each solenoid selector valve 93*a* is changed over to a position A depicted in FIG. 3 when a control validation switch 96 issues an instruction on invalidation of an area limiting control function, and the position thereof is changed over to a position B depicted in FIG. 3 when the control validation switch 96 issues an instruction on validation of the area limiting control function. When the solenoid selector valve 93*a* is at the position A depicted in FIG. 3, a pilot pressure signal inputted from the line 97 is output to the pilot port of each directional control valve or the flow control command pressure ports 3*a*, 3*b*, and 3*c* of the first to third hydraulic pumps 1, 2, and 3 via the line 98 or 99. One the other hand, when the solenoid selector valve 93*a* is at the position B, the pilot pressure signal inputted from the line 97 is output to the solenoid proportional valve unit 94 via the line 100. At the same time, a pilot pressure signal inputted from the solenoid proportional valve unit 94 via the line 101 is output to the pilot port of each directional control valve or the flow control command pressure ports 3*a*, 3*b*, and 3*c* of the first to third hydraulic pumps 1, 2, and 3 via the line 98 or 99.

Figure 4:
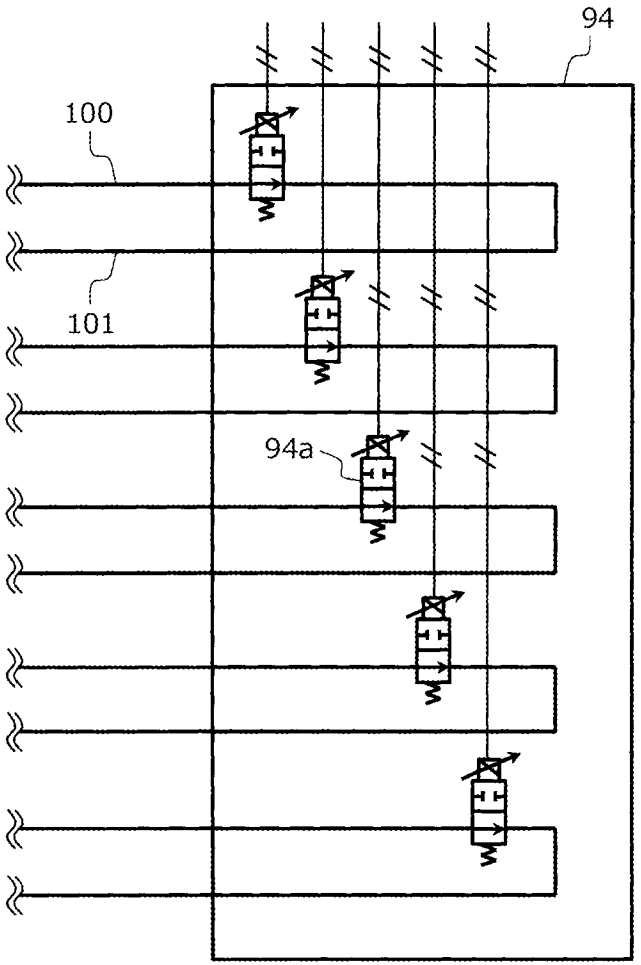
FIG. 4 is a configuration diagram of a solenoid proportional valve unit according to Embodiment 1 of the present invention.

FIG. 4 is a configuration diagram of the solenoid proportional valve unit 94. As depicted in FIG. 4, the solenoid proportional valve unit 94 incorporates therein a plurality of proportional solenoid pressure reducing valves 94*a* opening amounts of which are each controlled by a command from the controller 95. The pilot pressure signal inputted from one line 100 is corrected by the corresponding proportional solenoid pressure reducing valve 94*a* and output to the selector valve unit 93 via the corresponding line 101.

The hydraulic drive system 400 according to Embodiment 1 includes the controller 95, and output values from the pressure sensors 71*a*, 71*b*, 72*a*, 72*b*, 73*a*, 73*b*, 77, 78, 79*a*, 79*b*, 80, 81*a*, and 81*b*, output values from the stroke sensors 74, 75, and 76, and a command value of the control validation switch 96 are input to the controller 95. Furthermore, the controller 95 outputs commands to each selector valve provided in the selector valve unit 93, each solenoid valve provided in the solenoid proportional valve unit 94, and proportional solenoid pressure reducing valves 35 and 36 (as well as proportional solenoid pressure reducing valves that are not depicted).

Figure 5:
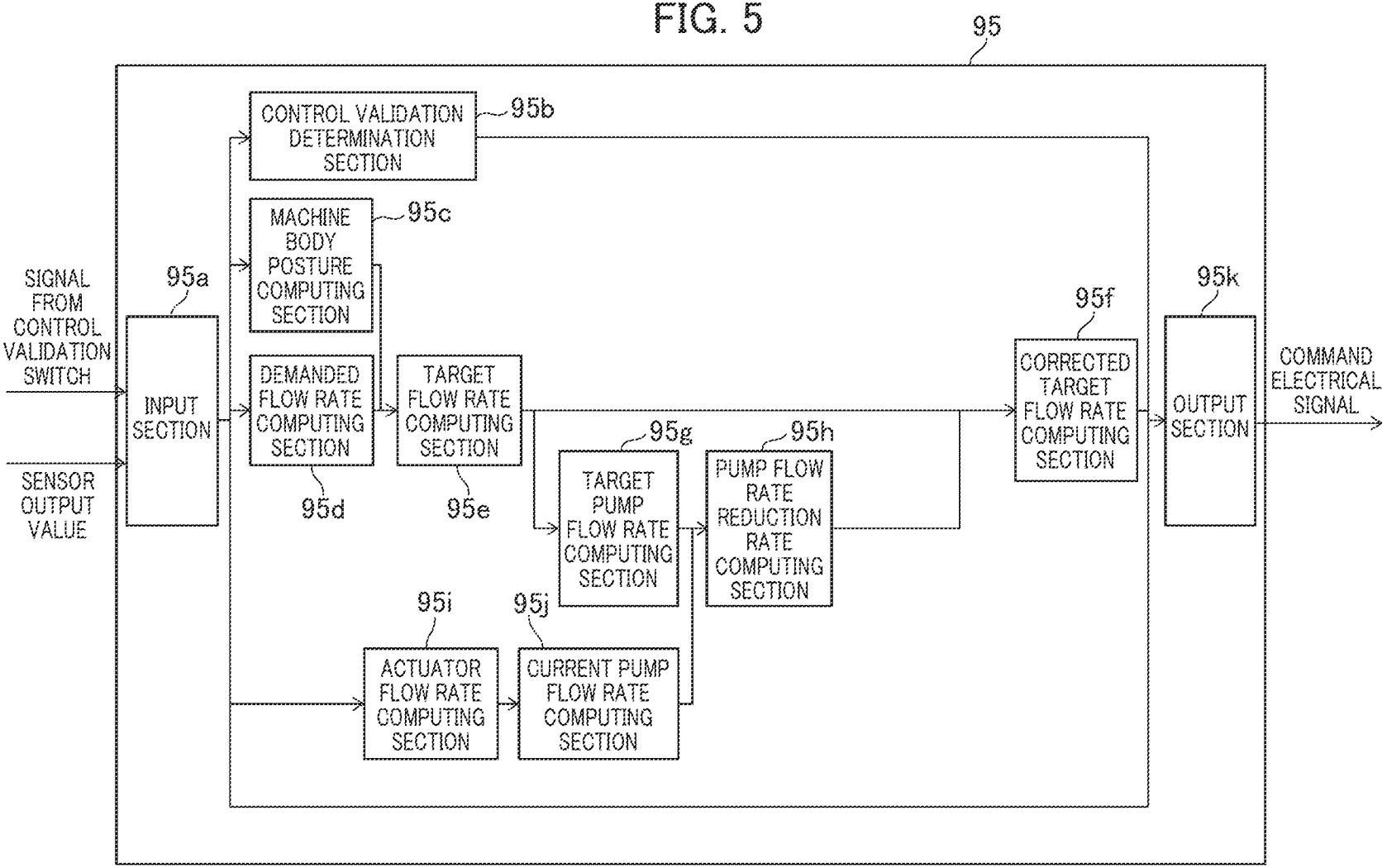
FIG. 5 is a functional block diagram of a controller according to Embodiment 1 of the present invention.

FIG. 5 is a functional block diagram of the controller 95. In FIG. 5, the controller 95 has an input section 95*a*, a control validation determination section 95*b*, a machine body posture computing section 95*c*, a demanded flow rate computing section 95*d*, a target flow rate computing section 95*e*, a corrected target flow rate computing section 95*f*, a target pump flow rate computing section 95*g*, a pump flow rate reduction rate computing section 95*h*, an actuator flow rate computing section 95*i*, a current pump flow rate computing section 95*j*, and an output section 95*k*.

The input section 95*a* acquires a signal from the control validation switch 96 and sensor output values. The control validation determination section 95*b* determines whether to validate or invalidate area limiting control on the basis of the signal from the control validation switch 96. The machine body posture computing section 95*c* computes postures of the swing structure 202 and the work device 203 on the basis of the sensor output values. The demanded flow rate computing section 95*d* computes a demanded flow rate of each actuator on the basis of the sensor output values. The target flow rate computing section 95*e* computes a target flow rate of each actuator on the basis of a posture of the machine body and the demanded flow rate. The target pump flow rate computing section 95*g* computes a target delivery flow rate (target pump flow rate) of each hydraulic pump on the basis of the target flow rate of each actuator outputted from the target flow rate computing section 95*e*. The actuator flow rate computing section 95*i* computes a current flow rate of each actuator on the basis of the sensor output values. The current pump flow rate computing section 95*j* computes a current delivery flow rate (current pump flow rate) of each hydraulic pump on the basis of the current flow rate of each actuator outputted from the actuator flow rate computing section 95*i*. The pump flow rate reduction rate computing section 95*h* computes a delivery flow rate reduction rate (pump flow rate reduction rate) of each hydraulic pump on the basis of the target pump flow rate and the current pump flow rate. The corrected target flow rate computing section 95*f* computes a corrected target flow rate of each actuator on the basis of the target flow rate outputted from the target flow rate computing section 95*e* and the pump flow rate reduction rate outputted from the pump flow rate reduction rate computing section 95*h*. The output section 95*k* generates command electrical signals on the basis of a determination result from the control validation determination section 95*b*, the corrected target flow rate from the corrected target flow rate computing section 95*f*, and the pressure sensor output values from the input section 95*a*, and outputs the generated command electrical signals to the selector valve unit 93, the solenoid proportional valve unit 94, and the proportional solenoid pressure reducing valves 35 and 36.

Figure 6A:
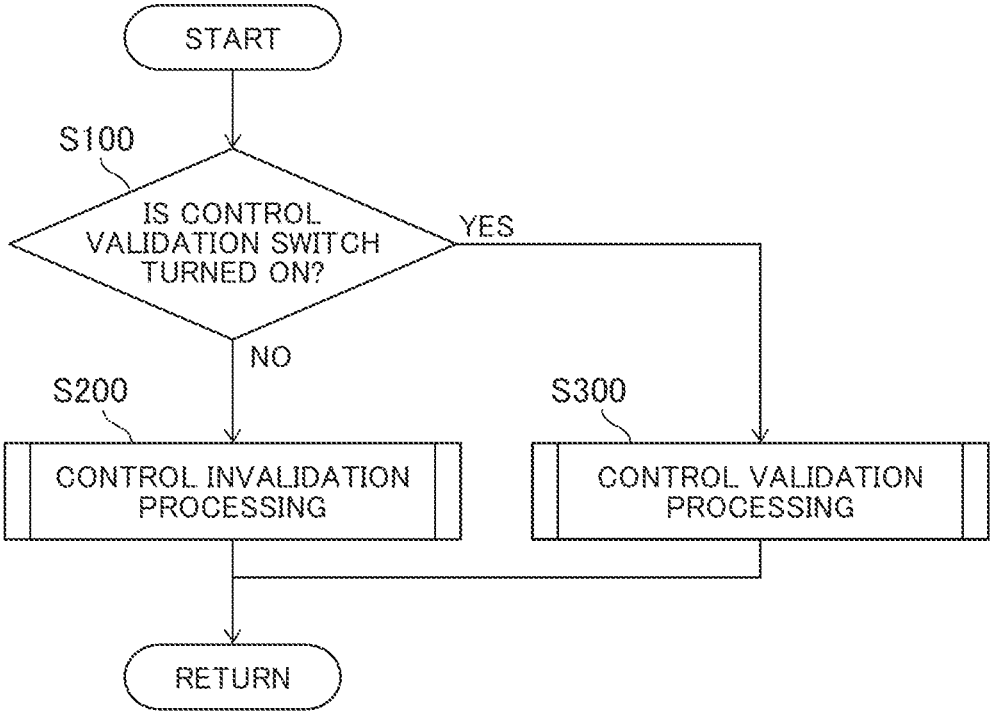
FIG. 6A is a flowchart depicting computing processing by the controller according to Embodiment 1 of the present invention.

FIG. 6A is a flowchart depicting computing processing by the controller 95 according to Embodiment 1. The controller 95 determines whether the control validation switch 96 is turned on (Step S100), executes control invalidation processing (Step S200) in a case of determining that the control validation switch 96 is turned off (NO), and executes control validation processing (Step S300) in a case of determining that the control validation switch 96 is turned on (YES).

Figure 6B:
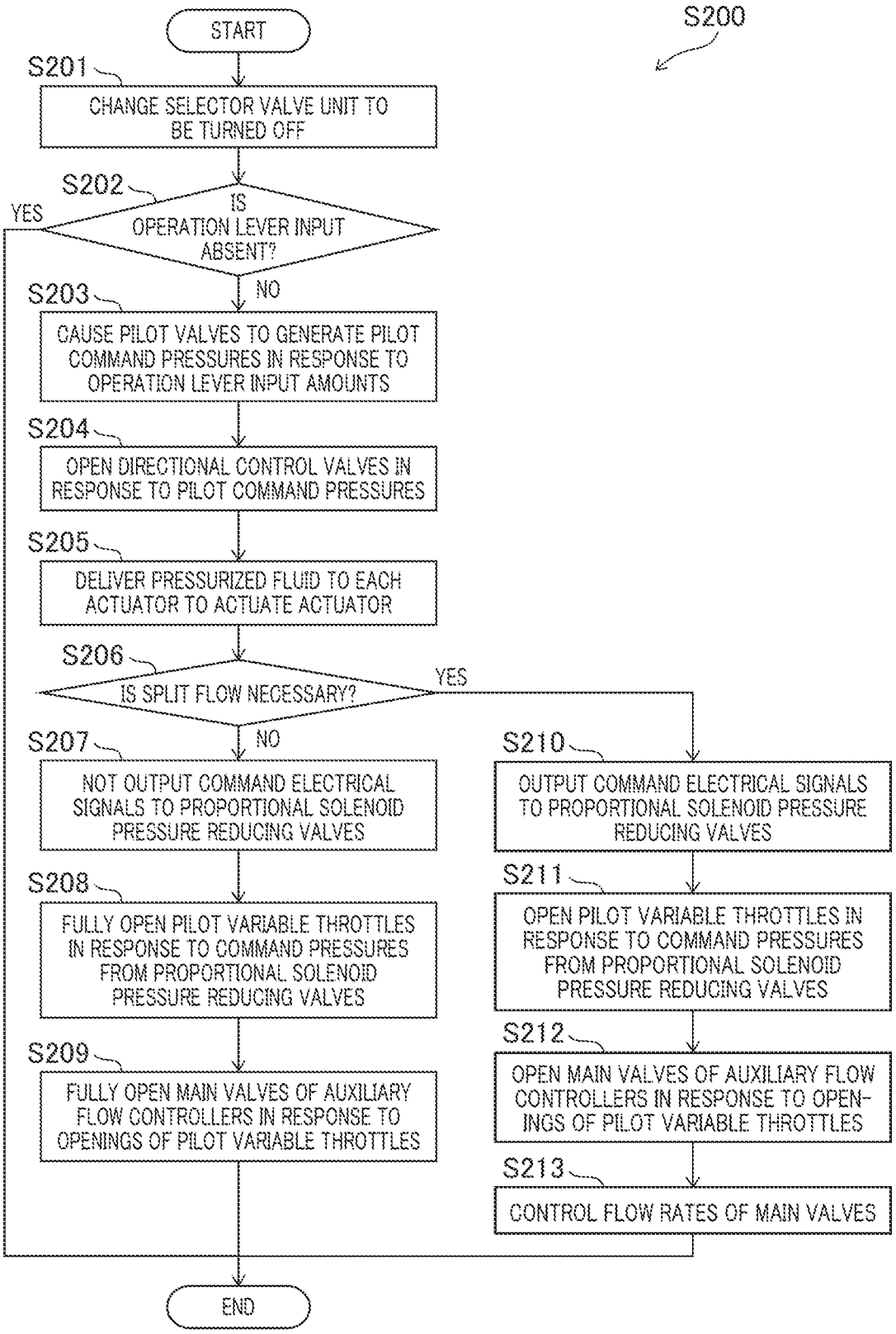
FIG. 6B is a flowchart depicting details of control invalidation processing according to Embodiment 1 of the present invention.

FIG. 6B is a flowchart depicting details of the control invalidation processing (Step S200). The controller 95 changes the selector valve unit 93 to be turned off (Step S201), and determines whether an operation lever input is absent (Step S202).

The controller 95 ends the control invalidation processing (Step S200) in a case of determining in Step S202 that an operation lever input is absent (YES).

In a case of determining in Step S202 that an operation lever input is present (NO), the controller 95 causes the pilot valves 92*a* and 92*b* to generate pilot command pressures in response to operation lever input amounts (Step S203), open the directional control valves in response to the pilot command pressures (Step S204), and delivers a hydraulic fluid to each actuator to actuate the actuator (Step S205). Subsequently to Step S205, the controller determines whether flow split is necessary for a plurality of actuators (Step S206).

In a case of determining in Step S206 that flow split is not necessary (NO), the controller 95 does not output command electrical signals to the proportional solenoid pressure reducing valves 35 and 36 (Step S207), fully opens the pilot variable throttles 32 and 34 (Step S208), fully opens the main valves 31 and 33 of the auxiliary flow controllers 24 and 25 in response to openings of the pilot variable throttles (Step S209), and ends the control invalidation processing (Step S200).

In a case of determining in Step S206 that flow split is not necessary (YES), the controller 95 outputs command electrical signals to the proportional solenoid pressure reducing valves 35 and 36 (Step S210), opens the pilot variable throttles 32 and 34 in response to command pressures from the proportional solenoid pressure reducing valves 35 and 36 (Step S211), opens the main valves 31 and 33 of the auxiliary flow controllers 24 and 25 in response to openings of the pilot variable throttles (Step S212), controls flow rates of the main valves 31, 33, and the like (flow rates delivered to the actuators from the directional control valves) (Step S213), and ends the control invalidation processing (Step S200).

Figure 6C:
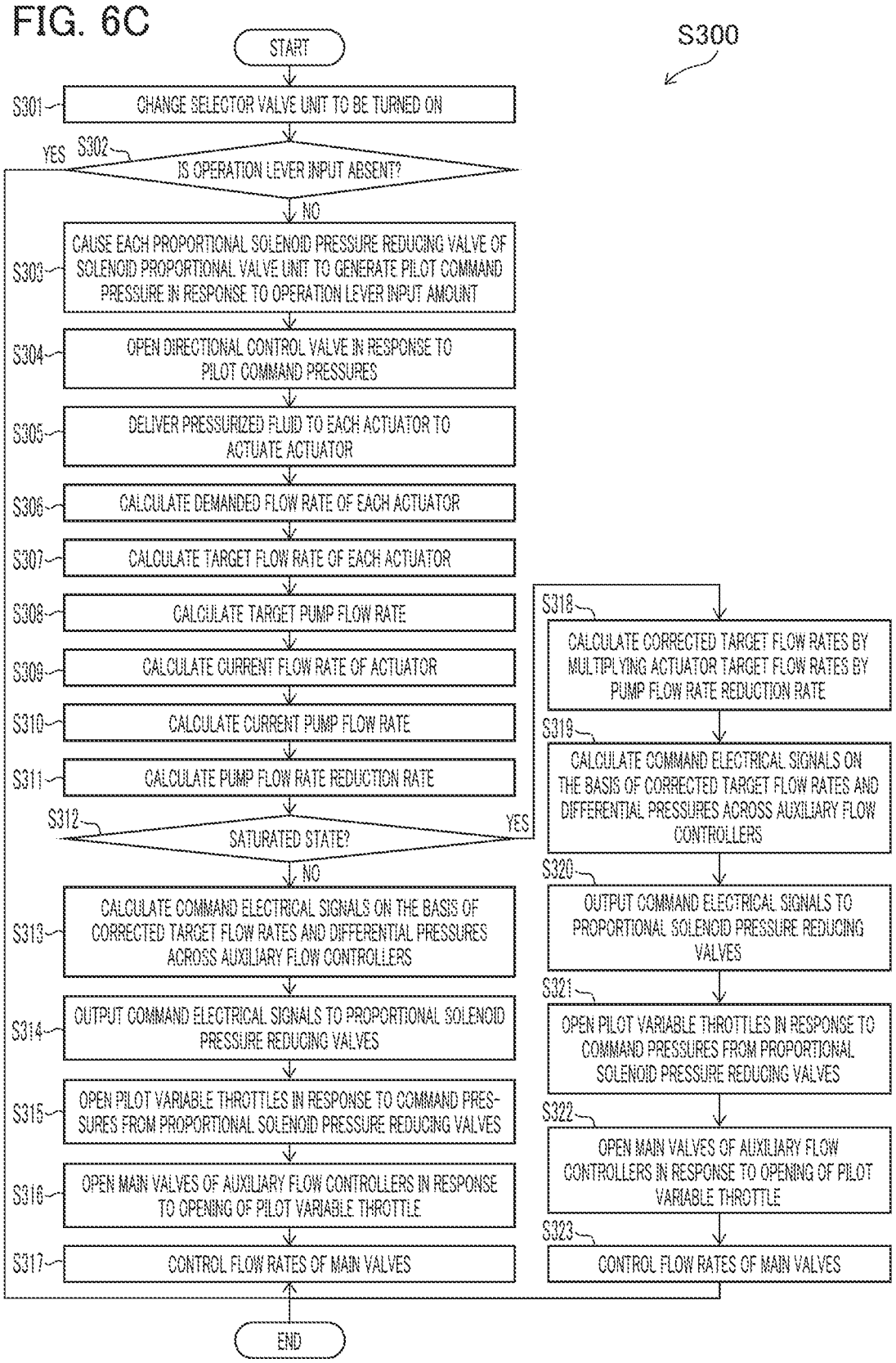
FIG. 6C is a flowchart depicting details of control validation processing according to Embodiment 1 of the present invention.

FIG. 6C is a flowchart depicting details of the control validation processing (Step S300). The controller 95 changes the selector valve unit 93 to be turned on (Step S301), and determines whether an operation lever input is absent (Step S302).

In a case of determining in Step S302 that an operation lever input is absent (YES), the controller 95 ends the control validation processing (Step S300).

In a case of determining in Step S302 that an operation lever input is present (NO), the controller 95 causes each proportional solenoid pressure reducing valve 94*a* of the solenoid proportional valve unit 94 to generate a pilot command pressure in response to the operation lever input amount (Step S303), opens the directional control valves in response to the pilot command pressures (Step S304), and delivers a hydraulic fluid to each actuator to actuate the actuator (Step S305).

Subsequently to Step S305, the controller 95 causes the demanded flow rate computing section 95*d* to calculate the demanded flow rate of each actuator (Step S306), causes the target flow rate computing section 95*e* to calculate the target flow rate of each actuator (Step S307), causes the target pump flow rate computing section 95*g* to calculate the target pump flow rate of each hydraulic pump (Step S308), causes the actuator flow rate computing section 95*i* to calculate the current flow rate of each actuator (Step S309), causes the current pump flow rate computing section 95*j* to calculate the current pump flow rate of each hydraulic pump (Step S310), and causes the pump flow rate reduction rate computing section 95*h* to calculate a pump flow rate reduction rate $\alpha$ from the target pump flow rate and the current pump flow rate of each hydraulic pump (Step S311). Subsequently to Step 311, the controller 95 determines whether the pump flow rate reduction rate a is lower than 1 (that is, each hydraulic pump is in a saturated state in which the flow rate of the hydraulic fluid that can be actually delivered from the hydraulic pump is lower than the target pump flow rate) (Step S312).

In a case of determining in Step S312 that the hydraulic pump is not in a saturated state (NO), the controller 95 causes the output section 95*k* to calculate command electrical signals on the basis of the target flow rate of each actuator and the differential pressures across the auxiliary flow controllers 24 and 25 (Step S313) and to output the command electrical signals to the proportional solenoid pressure reducing valves 35 and 36 (Step S314), opens the pilot variable throttles 32 and 34 in response to the command pressures from the proportional solenoid pressure reducing valves 35 and 36 (Step S315), opens the main valves 31 and 33 of the auxiliary flow controllers 24 and 25 in response to the openings of the pilot variable throttles (Step S316), controls the flow rates of the main valves 31 and 33 (flow rates delivered from the directional control valves to the actuators) (Step S317), and ends the control validation processing (Step S300).

In a case of determining in Step S312 that the hydraulic pump is in a saturated state (YES), the controller 95 causes the corrected target flow rate computing section 95*f* to calculate the corrected target flow rate by multiplying the target flow rate of each actuator by the pump flow rate reduction rate $\alpha$ (Step S318), causes the output section 95*k* to calculate the command electrical signals on the basis of the corrected target flow rates and the differential pressures across the auxiliary flow controllers 24 and 25 (Step S319) and to output the command electrical signals to the proportional solenoid pressure reducing valves 35 and 36 (Step S320), opens the pilot variable throttles 32 and 34 in response to the command pressures from the proportional solenoid pressure reducing valves 35 and 36 (Step S321), opens the main valves 31 and 33 of the auxiliary flow controllers 24 and 25 in response to the openings of the pilot variable throttles (Step S321), controls the flow rates of the main valves 31 and 33 (flow rates delivered from the directional control valves to the actuators) (Step S323), and ends the control validation processing (Step S300).

While the directional control valves, the auxiliary flow controllers, and the proportional solenoid pressure reducing valves for the boom 204 and the arm 205 are referred to as specific objects to be controlled in the above description, the flows depicted in FIGS. 6A to 6C are executed to all of the directional control valves, the auxiliary flow controllers, and the proportional solenoid pressure reducing valves including those not depicted.

(2) Operations

The hydraulic drive system 400 according to Embodiment 1 configured as described above is capable of the following operations and control. It is noted that a case of performing a three-combined operation of the boom 204, the arm 205, and the bucket 206 is adopted and the operation will be described for the sake of simple description.

"Operator's Manual Operation"

When the control validation switch 96 transmits a signal to invalidate the area limiting control over the hydraulic excavator 300 to the controller 95, the controller 95 changes over the hydraulic lines within the selector valve unit 93 in such a manner that the pilot command pressures generated from inputs to the operation levers 91*a* and 91*b* via the pilot valves 92*a* and 92*b* directly act on the pilot ports of the directional control valves of the actuators. It is thereby possible to drive each actuator in response to the operator's input operation amount.

The controller 95 calculates target opening amounts of the hydraulic variable throttle valves on the basis of operation amounts of the boom 204, the arm 205, and the bucket 206, and controls, for example, the opening amount of the hydraulic variable throttle valve 34 via the proportional solenoid pressure reducing valve 36 on the basis of opening characteristics of the hydraulic variable throttle valve 34 of the auxiliary flow controller 25 corresponding to the first arm directional control valve 11 and the operating pressure from the proportional solenoid pressure reducing valve 36 in such a manner that the opening amount of the hydraulic variable throttle valve 34 is equal to the target operation amount.

A displacement of the main valve 33 is determined herein only on the basis of the operator's operation input amount without depending on a load on the arm cylinder 205*a*. Owing to this, when the load on the arm cylinder 205*a* varies in a state of operator's maintaining an input amount of the operation lever 91*b*, the differential pressure across the main valve 33 changes and the flow rate by which the main valve 33 splits a flow to the arm cylinder 205*a* changes. This flow rate change is realistically reflected in a behavior of the arm cylinder 205*a*, and operator's recognizing the change makes it possible to adjust the input of the operation lever 91*b* and to perform an operator's intended operation.

"Automatic Operation Under Area Limiting Control"

When the control validation switch 96 transmits a signal to validate the area limiting control over the hydraulic excavator 300 to the controller 95, the controller 95 changes over the hydraulic lines within the selector valve unit 93 in such a manner that the pilot command pressures generated from the inputs to the operation levers 91*a* and 91*b* via the pilot valves 92*a* and 92*b* are guided to the solenoid proportional valve unit 94. The signal pressures guided to the solenoid proportional valve unit 94 are controlled by commands from the solenoid proportional pressure reducing valves 94*a* provided in the solenoid proportional valve unit 94 and the controller 95, and guided again to the selector valve unit 93. The signal pressures guided to the selector valve unit 93 are guided to the pilot ports of the directional control valves of the actuators.

It is thereby possible to drive each actuator under control of the controller 95 and the area limiting control is exercised over the hydraulic excavator 300.

The controller 95 calculates the target flow rate of each actuator on the basis of the operation amounts of the boom 204, the arm 205, and the bucket 206 and a machine body operating state acquired from each pressure sensor and each stroke sensor, and also calculates the target pump flow rate of each hydraulic pump on the basis of the target flow rate of each actuator. At the same time, the controller 95 calculates a meter-in current flow rate of each actuator on the basis of the differential pressure across the directional control valve acquired from the pressure sensors 80 and 81*b* (or pressure sensors 80 and 81*a*) attached to front and rear portions of the directional control valve, and opening area characteristics of the directional control valve with respect to the pilot pressure acting on the pressure command port of the directional control valve, and also calculates the current pump flow rate of each hydraulic pump on the basis of the current flow rate of each actuator. Further, the controller 95 calculates a pump flow rate reduction rate a on the basis of the target pump flow rate and the current pump flow rate.

In a case of the pump flow rate reduction rate $\alpha=1$, the controller 95 calculates the command electrical signal on the basis of the target flow rate of the main valve 33 and the differential pressure across the auxiliary flow controller 25 obtained from the pressure sensors 77 and 80 without correcting the target flow rate of the main valve 33, and outputs a command to the pilot variable throttle 34 via the proportional solenoid pressure reducing valve 36.

In a case of the pump flow rate reduction rate $\alpha<1$, the controller 95 calculates the corrected target flow rate by multiplying the target flow rate of the actuator by a, calculates the command electrical signal on the basis of the corrected target flow rate of the main valve 33 and the differential pressure across the auxiliary flow controller 25 obtained from the pressure sensors 77 and 80, and outputs a command to the pilot variable throttle 34 via the proportional solenoid pressure reducing valve 36.

While the operation of the auxiliary flow controller 25 has been described above, the other auxiliary flow controller operate similarly.

According to Embodiment 1, a work machine 300 includes: a travel structure 201; a swing structure 202 swingably attached onto the travel structure 201; a work device 203 attached to the swing structure 202; a plurality of hydraulic actuators 204*a*, 205*a*, 206*a*, and the like driving the swing structure 202 or the work device 203; hydraulic pumps 1, 2, and 3; regulators 1*a*, 1*b*, 1*c*, 2*a*, 2*b*, 2*c*, 3*a*, and 3*b* exercising horsepower control over the hydraulic pumps 1, 2, and 3 in response to load pressures of the plurality of hydraulic actuators 204*a*, 205*a*, 206*a*, and the like; a plurality of directional control valves connected to delivery lines of the hydraulic pumps 1, 2, and 3 in parallel and regulating supply flow rates to the plurality of hydraulic actuators from the hydraulic pumps 1, 2, and 3; operation lever devices 91*a* and 91*b* for issuing instructions on operations of the plurality of hydraulic actuators 204*a*, 205*a*, 206*a*, and the like; a pilot pump 4; operation pressure generation valve devices 93 and 94 reducing a delivery pressure of the pilot pump 4 in response to operation instruction amounts from the operation lever devices 91*a* and 91*b*, and outputting the reduced delivery pressure as operation pressures of the plurality of directional control valves 7 to 12 and 14 to 16; a control validation switch 96 for issuing an instruction to validate or invalidate an area limiting control function to prevent entry of the work device 303 into a preset area; and a controller 95 that controls the operation pressure generation valve devices 93 and 95 in such a manner as to output the operation pressures in response to the operation instruction amounts from the operation lever devices 91*a* and 91*b* in a case in which the control validation switch 96 issues an instruction to invalidate the area limiting control function, and that controls the operation pressure generation valve devices 93 and 94 in such a manner as to correct the operation pressures in response to the operation instruction amounts from the operation lever devices 91*a* and 91*b* and to output the corrected operation pressures in a case in which the control validation switch 96 issues an instruction to validate the area limiting control function. The work machine 300 includes a plurality of auxiliary flow controllers 21 to 29 that are connected to upstream of the plurality of directional control valves 7 to 12 and 14 to 16 and that can limit supply flow rates to the plurality of directional control valves 7 to 12 and 14 to 16 from the hydraulic pumps 1, 2, and 3. The controller 95 controls the plurality of auxiliary flow controllers 21 to 29 in such a manner that the supply flow rates to the plurality of directional control valves 7 to 12 and 14 to 16 from the hydraulic pumps 1, 2, and 3 fluctuate in response to load fluctuations of the plurality of hydraulic actuators 204*a*, 205*a*, 206*a*, and the like in the case in which the control validation switch 96 issues an instruction to invalidate the area limiting control function, controls the plurality of auxiliary flow controllers 21 to 29 in such a manner that the supply flow rates to the plurality of directional control valves 7 to 12 and 14 to 16 from the hydraulic pumps 1, 2, and 3 do not fluctuate in response to the load fluctuations of the plurality of hydraulic actuators 204*a*, 205*a*, 206*a*, and the like in the case in which the control validation switch 96 issues an instruction to validate the area limiting control function, and controls the plurality of auxiliary flow controllers 21 to 29 in such a manner that the supply flow rates to the plurality of directional control valves 7 to 12 and 14 to 16 from the hydraulic pumps 1, 2, and 3 are reduced in response to the pump flow rate reduction rate $\alpha$ that is a ratio of the current delivery flow rate to the target delivery flow rate, at a time of occurrence of saturation indicating that the current delivery flow rate of each of the hydraulic pumps 1, 2, and 3 is reduced to be lower than the target delivery flow rate of each of the hydraulic pumps 1, 2, and 3 due to the horsepower control in the case in which the control validation switch 96 issues an instruction to validate the area limiting control function.

Furthermore, the plurality of auxiliary flow controllers 21 to 29 have sheet-shaped main valves 31, 33, and the like forming auxiliary variable throttles; control variable throttles 31*b*, 33*b*, and the like changing opening areas in response to movement amounts of sheet valve bodies of the main valves 31, 33, and the like; pilot lines 63, 64, and the like determining movement amounts of the sheet valve bodies in response to pass-through flow rates; and pilot variable throttles 32, 34, and the like disposed on the pilot lines 63, 64, and the like and changing opening amounts in response to commands from the controller 95, respectively. The controller 95 controls the opening amounts of the pilot variable throttles 32, 34, and the like in such a manner that the pass-through flow rates of the main valves 31, 33, and the like fluctuate in response to the load fluctuations of the plurality of hydraulic actuators 204*a*, 205*a*, 206*a*, and the like in the case in which the control validation switch 96 issues an instruct to invalidate the area limiting control function; and controls the opening amounts of the pilot variable throttles 32, 34, and the like in such a manner that the pass-through flow rates of the main valves 31, 33, and the like do not fluctuate in response to the load fluctuations of the plurality of hydraulic actuators 204*a*, 205*a*, 206*a*, and the like, and controls the opening amounts of the pilot variable throttles 32, 34, and the like in such a manner that the pass-through flow rates of the main valves 31, 33, and the like are reduced in response to the pump flow rate reduction rate a at the time of occurrence of the saturation in the case in which the control validation switch 96 issues an instruction to validate the area limiting control function.

Moreover, the pilot variable throttles 32, 34, and the like are each configured with a hydraulic variable throttle valve, the work machine 300 further includes: first pressure sensors 77 and the like provided at delivery lines of the hydraulic pumps 1, 2, and 3; second pressure sensors 78, 80, and the like provided at hydraulic lines connecting the plurality of directional control valves 7 to 12 and 14 to 16 to the main valves 31, 33, and the like; and proportional solenoid pressure reducing valves 35, 36, and the like reducing the delivery pressure of the pilot pump 4 in response to a command from the controller 95 and outputs the reduced delivery pressure as the operation pressures of the hydraulic variable throttle valves 32, 34, and the like. The controller 95 calculates target opening amounts of the hydraulic variable throttle valves 32, 34, and the like on the basis of the operation instruction amounts from the operation lever devices 91 and 91*b*, calculates current opening amounts of the hydraulic variable throttle valves 32, 34, and the like on the basis of opening characteristics of the hydraulic variable throttle valves 32, 34, and the like and operation pressures of the hydraulic variable throttle valves 32, 34, and the like, and controls opening amounts of the hydraulic variable throttle valves 32, 34, and the like via the proportional solenoid pressure reducing valves 35, 36, and the like in such a manner as to reduce differences between the target opening amounts and the current opening amounts in the case in which the control validation switch 96 issues an instruction to invalidate the area limiting control function; and calculates target pass-through flow rates of the main valves 31, 33, and the like on the basis of the operation instruction amounts from the operation lever devices 91*a* and 91*b*, calculates current pass-through flow rates of the main valves 31, 33, and the like on the basis of the differential pressures across the main valves 31, 33, and the like detected by the first pressure sensor 77, the second pressure sensors 78, 80, and the like and the current opening amounts of the main valves 31, 33, and the like with respect to the operation pressures outputted from the proportional solenoid pressure reducing valves 35, 36, and the like, and controls the opening amounts of the hydraulic variable throttle valves 32, 34, and the like via the proportional solenoid pressure reducing valves 35, 36, and the like in such a manner as to reduce differences between the target pass-through flow rates and the current pass-through flow rates in the case in which the control validation switch 96 issues an instruction to validate the area limiting control function.

Moreover, the work machine 300 further includes a differential-pressure-across-valve sensor that detects the differential pressures across the plurality of directional control valves 7 to 12 and 14 to 16, and calculates the current opening amounts of the plurality of directional control valves 7 to 12 and 14 to 16 on the basis of the opening characteristics of the plurality of directional control valves 7 to 12 and 14 to 16 and the operation pressures outputted from the operation pressure generation valve devices 93 and 94. The controller 95 calculates current supply flow rates to the plurality of actuators 204*a*, 205*a*, 206*a*, and the like from the plurality of directional control valves 7 to 12 and 14 to 16 on the basis of the differential pressures across the plurality of directional control valves 7 to 12 and 14 to 16 detected by the differential-pressure-across-valve sensor and the current opening amounts of the plurality of directional control valves 7 to 12 and 14 to 16, and calculates the current delivery flow rates of the hydraulic pumps 1, 2, and 3 by adding up the current supply flow rates to the plurality of actuators 204*a*, 205*a*, 206*a*, and the like from the plurality of directional control valves 7 to 12 and 14 to 16.

Furthermore, the differential-pressure-across-valve sensor includes: the second pressure sensors 78, 80, and the like provided at the hydraulic lines connecting the plurality of directional control valves 7 to 12 and 14 to 16 to the main valves 31, 33, and the like; and third pressure sensors 79*b*, 81*b*, and the like (79*a*, 81*a*, and the like) provided at hydraulic lines connecting hydraulic operating fluid supply-side ports of the plurality of hydraulic actuators 204*a*, 205*a*, 206*a*, and the like to the plurality of directional control valves 7 to 12 and 14 to 16.

(3) Effects

According to Embodiment 1 configured as described so far, in the case in which the area limiting control function is invalid, then the flow control of the auxiliary flow controllers 21 to 29 is made invalid, and the auxiliary flow controllers 21 to 29 maintain openings in response to the operator's operation input amounts and split a flow for the plurality of hydraulic actuators. In this case, the operator is more sensitive to the change in each actuator operation in response to the load fluctuation of the actuator; thus, it is possible to ensure operability of the hydraulic excavator 300 at the time of the operator's operation. On the other hand, in the case in which the area limiting control function is valid, the auxiliary flow controllers 21 to 29 can supply the hydraulic fluid at the flow rate agreeable to the target flow rate commanded by the controller 95 to each actuator without depending on the load fluctuation of the actuator with high responsiveness and with stability; thus, it is possible to improve automatic control accuracy of the actuator. Furthermore, even in the saturated state, it is possible to maintain a flow split ratio to each actuator and to exercise automatic control without degrading actuator control accuracy. As described so far, changing over to hydraulic system characteristics suited for each of two types of operation modes, that is, an operation mode during the operator's manual operation and an operation mode during the automatic control by the controller 95 makes it possible to ensure demanded performances in the two operation modes.

Embodiment 2

Figure 7A:
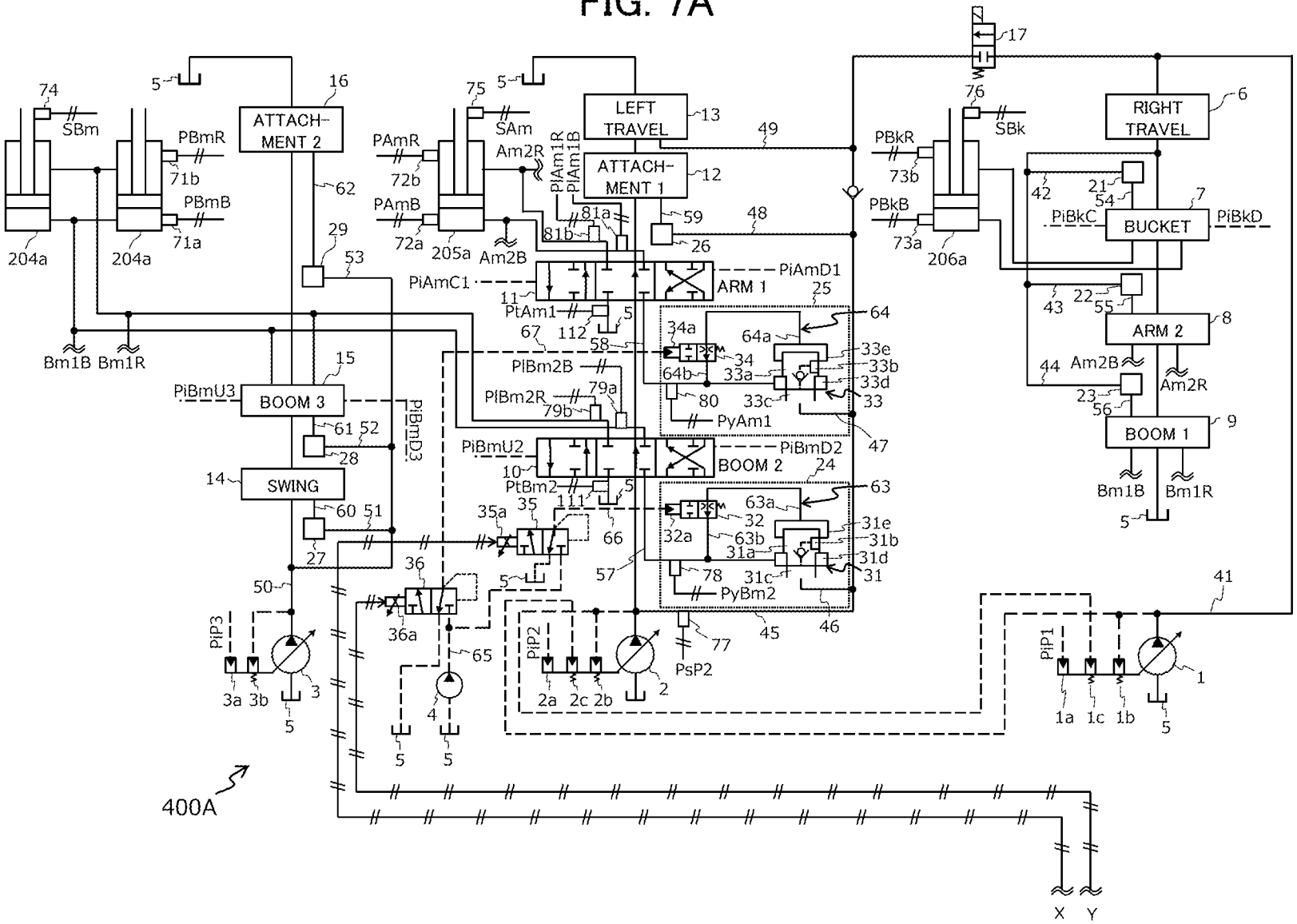
FIG. 7A is a circuit diagram (1/2) of a hydraulic drive system according to Embodiment 2 of the present invention.
Figure 7B:
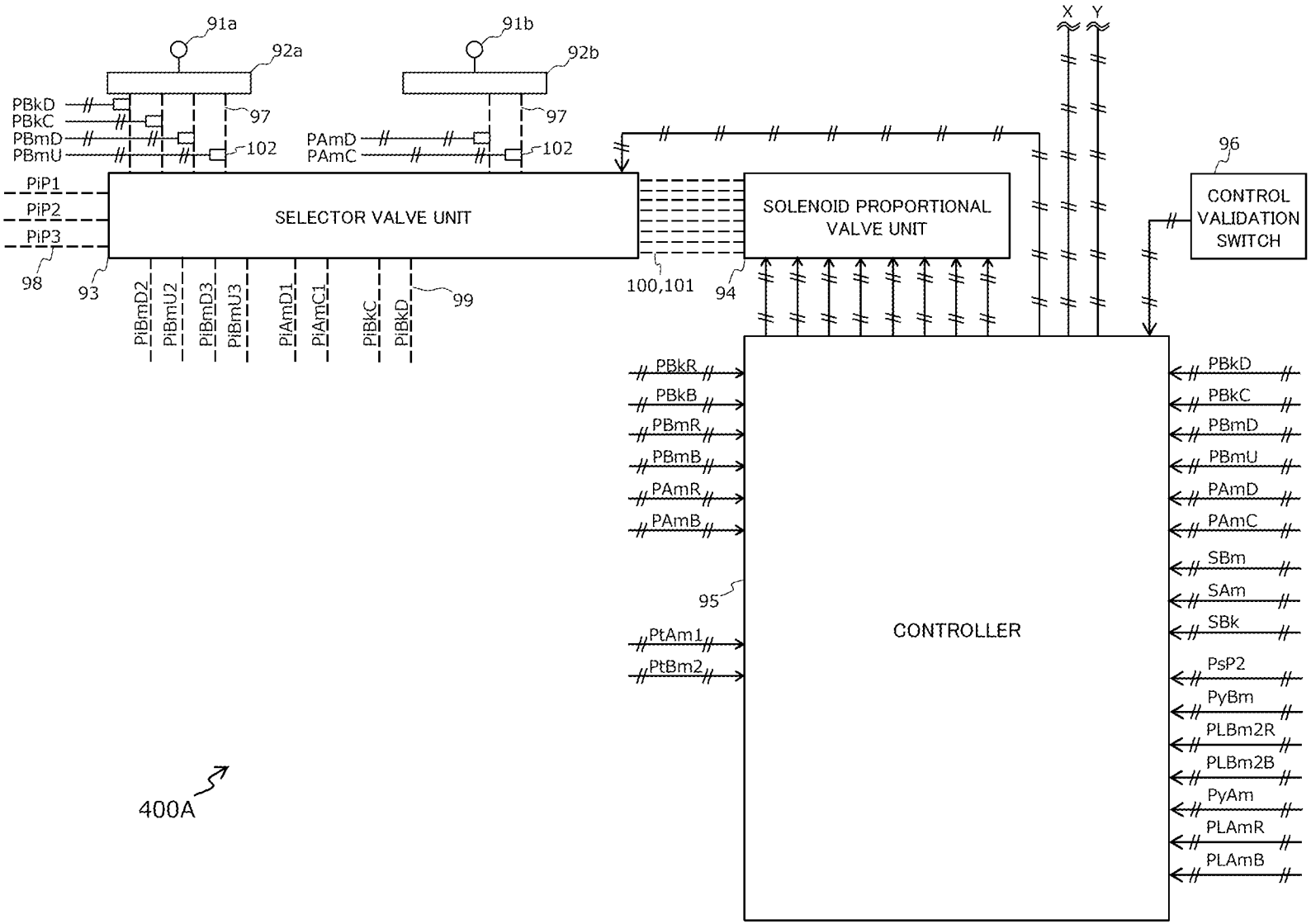
FIG. 7B is a circuit diagram (1/2) of the hydraulic drive system according to Embodiment 2 of the present invention.

FIGS. 7A and 7B are circuit diagrams of a hydraulic drive system according to Embodiment 2 of the present invention.

(1) Configurations

As depicted in FIGS. 7A and 7B, a hydraulic drive system 400A according to Embodiment 2 are almost similar in configurations to the hydraulic drive system 400 according to Embodiment 1 (depicted in FIGS. 2A and 2B) except for the following respects.

A pressure sensor 111 is provided at a tank line of the second boom directional control valve 10, and a pressure sensor 112 is provided at a tank line of the first arm directional control valve 11.

While partial configurations are not depicted for the sake of simple description, auxiliary flow controllers 21 to 29 and surrounding instruments, lines, and interconnections are all identical to those depicted in FIGS. 7A and 7B in configuration. Furthermore, computing processing of the controller 95 is similar to that according to Embodiment 1 (depicted in FIGS. 6A, 6B, and 6C).

(2) Operations

The hydraulic drive system 400A according to Embodiment 2 is almost similar in operations to the hydraulic drive system 400 according to Embodiment 1 except for the following respects.

"Automatic Operation Under Area Limiting Control"

In a state in which the signal to validate the area limiting control over the hydraulic excavator 300 is transmitted from the control validation switch 96 to the controller 95 and an automatic operation is performed under the area limiting control, the controller 95 calculates the target flow rate of each actuator on the basis of the operation amounts of the boom 204, the arm 205, and the bucket 206 and the machine body operating state acquired from each pressure sensor and each stroke sensor, and also calculates the target pump flow rate of each hydraulic pump on the basis of the target flow rate of each actuator. At the same time, the controller 95 calculates a meter-out current flow rate of each actuator on the basis of the differential pressure across the directional control valve acquired from the pressure sensors 81*b* and 112 (or pressure sensors 81*a* and 112) attached to front and rear portions of the directional control valve, and the opening area characteristics of the directional control valve with respect to the pilot pressure acting on the pressure command port of the directional control valve, and also calculates the current pump flow rate of each hydraulic pump on the basis of the current flow rate of each actuator. Furthermore, the controller 95 calculates the pump flow rate reduction rate α on the basis of the target pump flow rate and the current pump flow rate.

(3) Effects

According to Embodiment 2, the differential-pressure-across-valve sensor that detects the differential pressures across the plurality of directional control valves 7 to 12 and 14 to 16 is configured with fourth pressure sensors 79*a*, 81*a*, and the like (79*b*, 81*b*, and the like) provided at hydraulic lines connecting hydraulic operating fluid discharge-side ports of the plurality of hydraulic actuators 204*a*, 205*a*, 206*a*, and the like to the plurality of directional control valves 7 to 12 and 14 to 16; and fifth pressure sensors 111, 112, and the like provided at hydraulic lines connecting the plurality of directional control valves 7 to 12 and 14 to 16 to a hydraulic operating fluid tank 5.

Embodiment 2 configured as described so far can attain the following effects in addition to similar effects to those of Embodiment 1.

Measuring the pressure of each actuator circuit and the pressure of a tank circuit on a meter-out side of each directional control valve makes it possible to accurately calculate the current flow rate of the actuator even in a hydraulic circuit prone to a deviation between an operation of the actuator and a meter-in side flow rate such as an actuator (for example, swing motor) driving a large inertial element. It is thereby possible to calculate the current pump flow rate and the pump flow rate reduction rate a more accurately, and to operate each actuator more stably with a split flow ratio during saturation.

Embodiment 3

Embodiment 3 of the present invention will be described while mainly referring to differences from Embodiment 1.

(1) Configurations

While a hydraulic drive system according to Embodiment 3 is similar in configurations to the hydraulic drive system 400 according to Embodiment 1 (depicted in FIGS. 2A and 2B), a content of processing by the controller 95 differs from that according to Embodiment 1.

Figure 8:
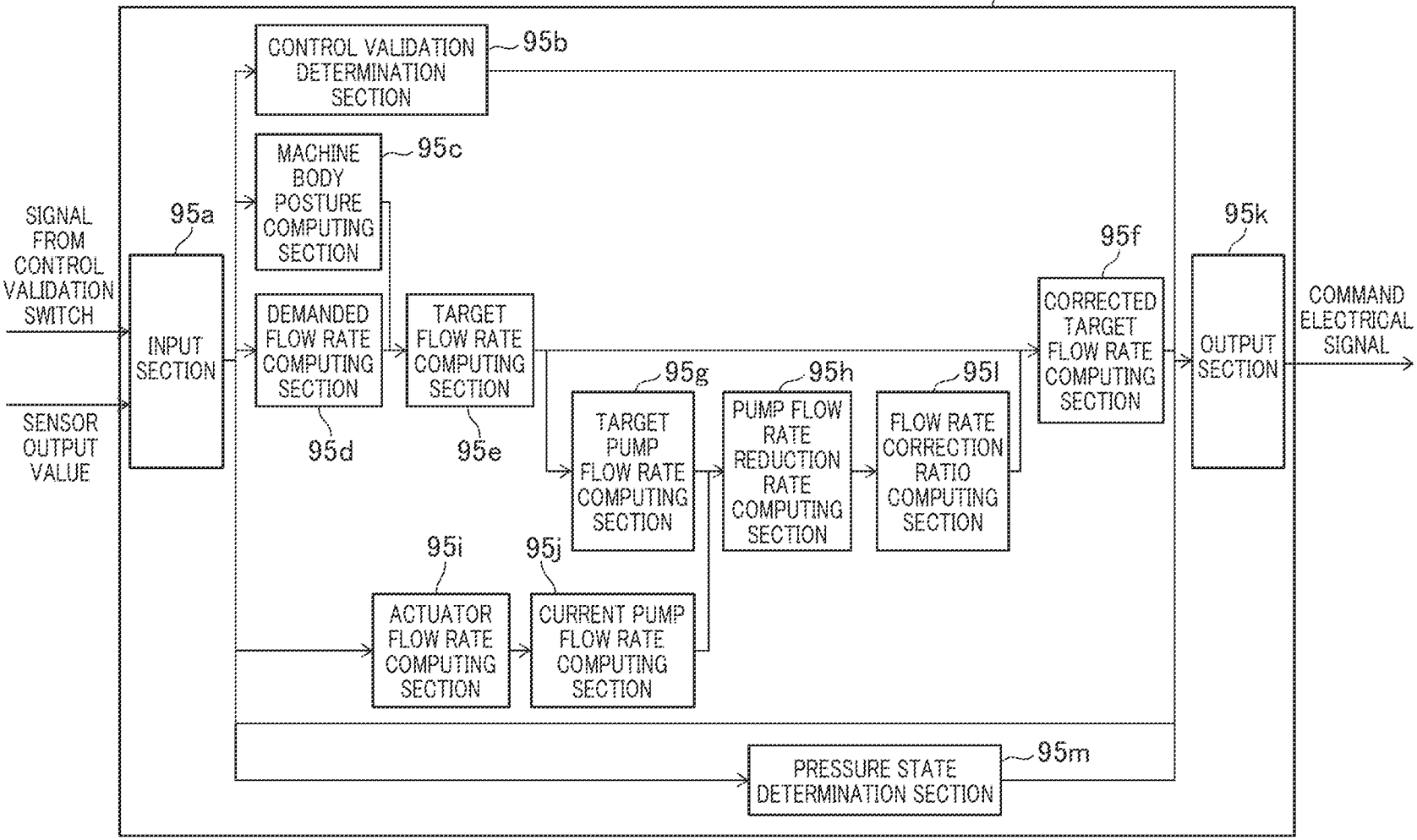
FIG. 8 is a functional block diagram of a controller according to Embodiment 3 of the present invention.

FIG. 8 is a functional block diagram of the controller 95 according to Embodiment 3. In FIG. 8, the controller 95 has a flow rate correction ratio computing section 95*l* and a pressure state determination section 95*m* in addition to the configurations of the controller 95 according to Embodiment 1 (depicted in FIG. 5).

The flow rate correction ratio computing section 95*l* computes a flow rate correction ratio β by multiplying the pump flow rate reduction rate α from the pump flow rate reduction rate computing section 95*h* by a correction ratio γ preset to each actuator. The corrected target flow rate computing section 95*f* computes the corrected target flow rate of each actuator on the basis of the target flow rate from the target flow rate computing section 95*e* and the flow rate correction ratio β from the flow rate correction ratio computing section 95*l*. The pressure state determination section 95*m* determines an actuator having a highest load pressure among the actuators for which split flow is necessary on the basis of the pressure sensor output values of the input section 95*a*. The output section 95*k* generates command electrical signals on the basis of a determination result from the control validation determination section 95*b*, the corrected target flow rate from the corrected target flow rate computing section 95*f*, the pressure sensor output values from the input section 95*a*, and a determination result of the pressure state determination section 95*m*, and outputs the generated command electrical signals to the selector valve unit 93, the solenoid proportional valve unit 94, and the proportional solenoid pressure reducing valves 35 and 36.

FIG. 6A is a flowchart depicting computing processing by a controller 95A according to Embodiment 3 of the present invention. The controller 95A determines whether the control validation switch 96 is turned on (Step S100), executes the control invalidation processing (Step S200) in the case of determining that the control validation switch 96 is turned off (NO), and executes control validation processing (Step S300A) in the case of determining that the control validation switch 96 is turned on (YES).

Figure 9A:
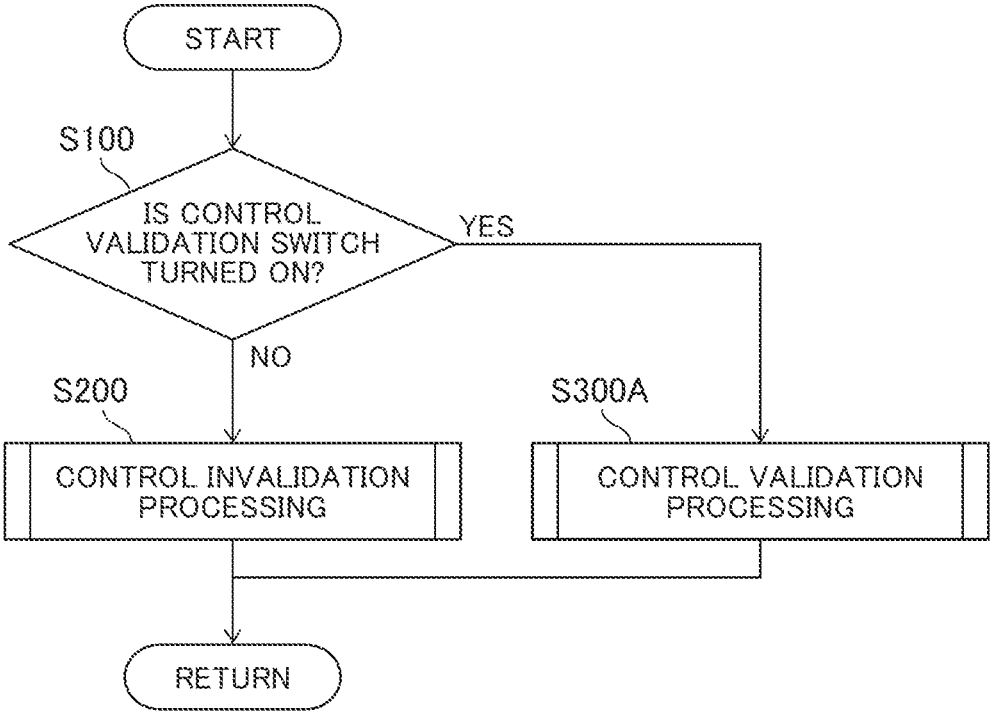
FIG. 9A is a flowchart depicting computing processing by the controller according to Embodiment 3 of the present invention.
Figure 9B:
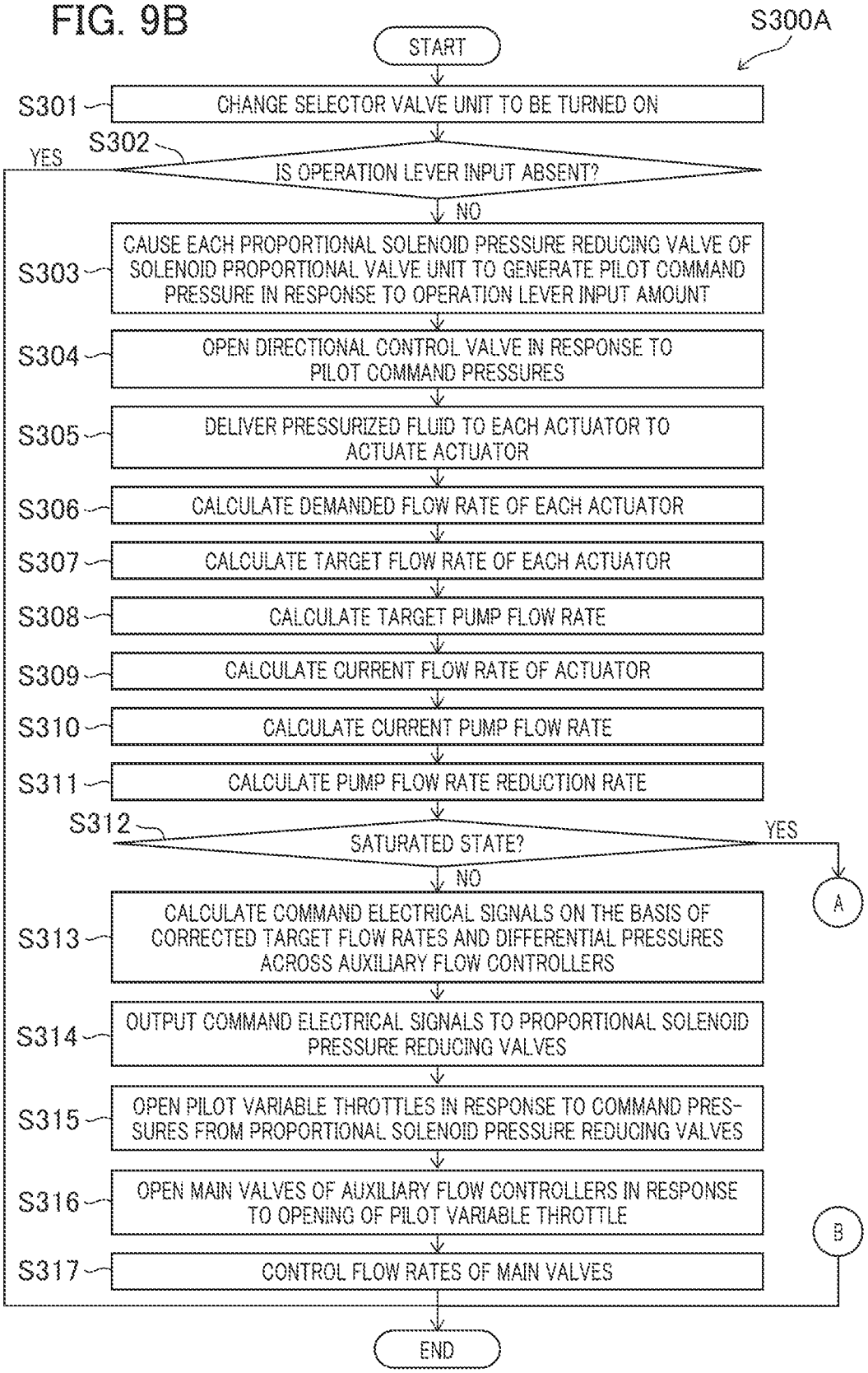
FIG. 9B is a flowchart (1/2) depicting details of control validation processing according to Embodiment 3 of the present invention.
Figure 9C:
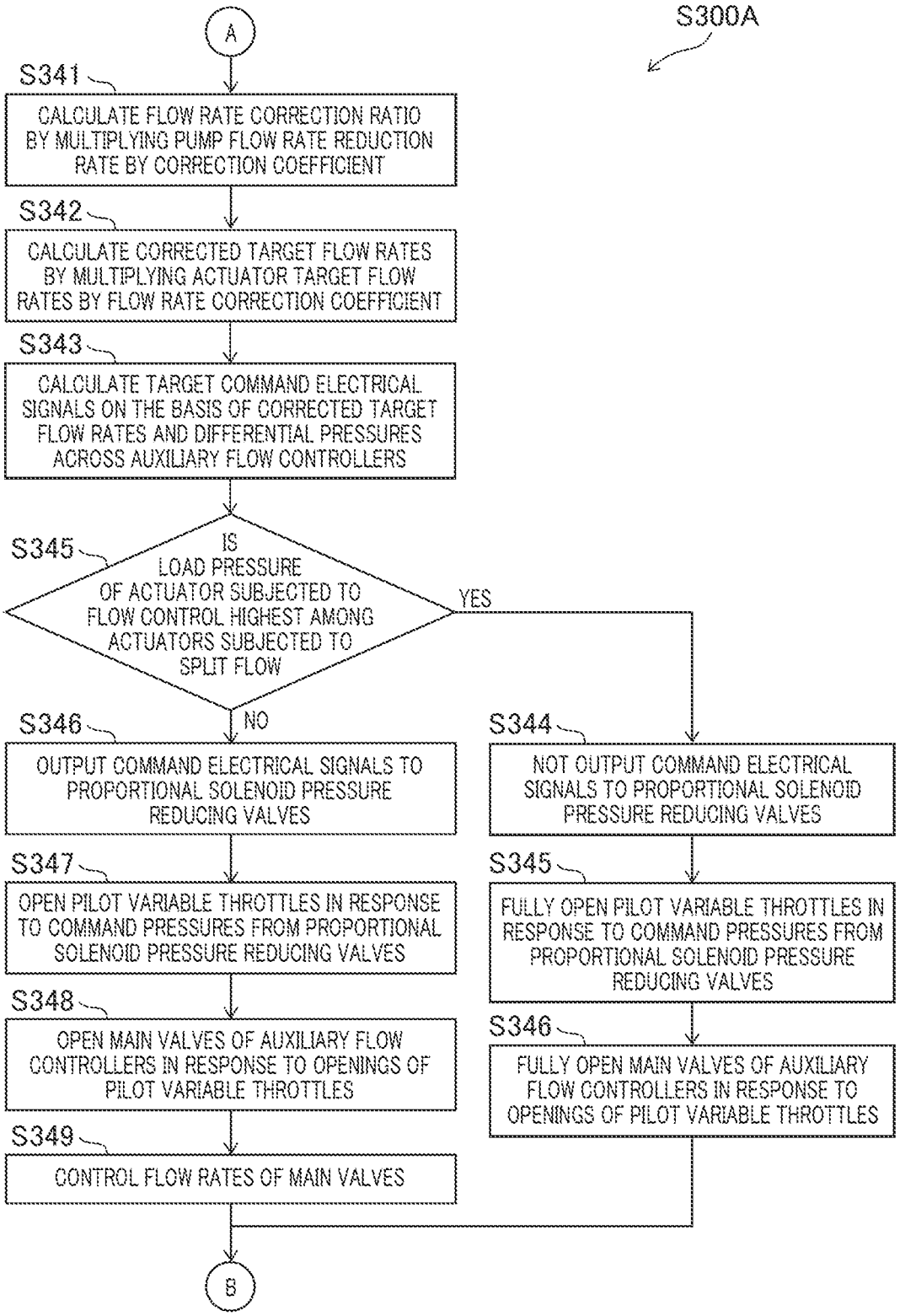
FIG. 9C is a flowchart (2/2) depicting the details of the control validation processing according to Embodiment 3 of the present invention.

FIGS. 9B and 9C are flowcharts depicting details of the control validation processing (Step S300A). In FIG. 9B, Steps S301 to S317 are similar to those according to Embodiment 1 (depicted in FIG. 6C).

In a case of determining in Step S312 that the hydraulic pump is in a saturated state (YES), the controller 95 causes the flow rate correction ratio computing section 95*l* to calculate the flow rate correction ratio β by multiplying the pump flow rate reduction rate α by the correction coefficient γ preset to the actuator subjected to flow control (Step S341), causes the corrected target flow rate computing section 95*f* to calculate the corrected target flow rate by multiplying the target flow rate of the actuator subjected to the flow control by the flow rate correction ratio β (Step S342), causes the output section 95*k* to calculate the command electrical signals on the basis of the corrected target flow rate and the differential pressures across the auxiliary flow controllers 24 and 25 (Step S343), and causes the pressure state determination section 95*m* to determine whether the load pressure of the actuator subjected to the flow control is highest among the actuators subjected to split flow on the basis of the pressure sensor output values from the input section 95*a* (Step S345).

In a case of determining in Step S345 that the load pressure of the actuator subjected to the flow control is not the highest load pressure among those of the actuators subjected to split flow (NO), the controller 95 causes the output section 95*k* to output the command electrical signals to the proportional solenoid pressure reducing valves 35 and 36 (Step S346), opens the pilot variable throttles 32 and 34 in response to the command pressures from the proportional solenoid pressure reducing valves 35 and 36 (Step S347), opens the main valves 31 and 33 of the auxiliary flow controllers 24 and 25 in response to the openings of the pilot variable throttles (Step S348), controls the flow rates of the main valves 31 and 33 (flow rates delivered to the actuators from the directional control valves) (Step S349), and ends the control validation processing (Step S300).

In a case of determining in Step S345 that the load pressure of the actuator subjected to the flow control is the highest among the actuators subjected to split flow (YES), the controller 95 causes the output section 95*k* not to output command electrical signals to the proportional solenoid pressure reducing valves 35 and 36 (Step S344), fully opens the pilot variable throttles 32 and 34 in response to the command pressures (tank pressures) from the proportional solenoid pressure reducing valves 35 and 36 (Step S345), fully opens the main valves 31 and 33 of the auxiliary flow controllers 24 and 25 in response to the openings of the pilot variable throttles (Step S346), and ends the control validation processing (Step S300*a*).

Figure 10B:
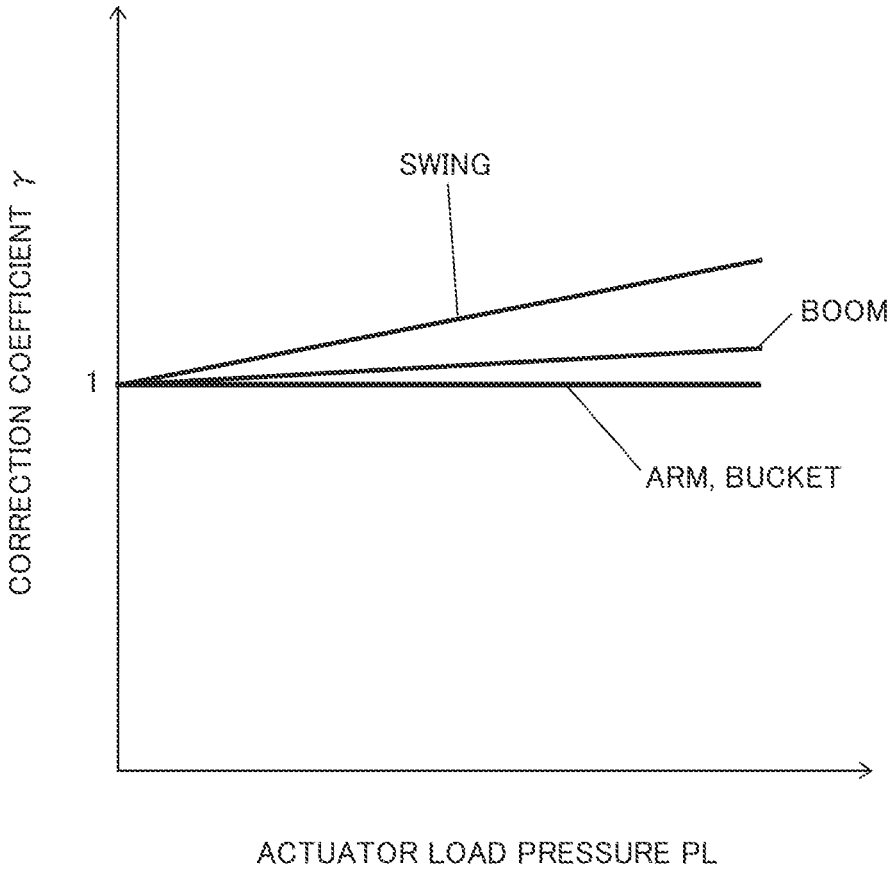
FIG. 10B is a diagram depicting an example of a correction coefficient according to Embodiment 3 of the present invention.

Here, the flow rate correction ratio β, is obtained by a product between the correction coefficient γ set to each actuator and the pump flow rate reduction rate α, as depicted in FIG. 10A. In addition, the correction coefficient γ is not always constant, and may vary depending on a load pressure P1 of the actuator, as exemplarily depicted in FIG. 10B.

While the directional control valves, the auxiliary flow controllers, and the proportional solenoid pressure reducing valves for the boom 204 and the arm 205 are referred to as specific objects to be controlled in the above description, the flows depicted in FIGS. 9A to 9C are executed with respect to all of the directional control valves, the auxiliary flow controllers, and the proportional solenoid pressure reducing valves including those not depicted. Furthermore, while a case of setting high the flow rate correction ratio β of each of the actuators (swing motor and boom cylinder 204*a*) each of which drives a large inertial element and the flow rate change of each of which has a great influence on the behavior of the inertial element is exemplarily described above, the flow rate correction ratio β of each actuator is set optionally by a designer or the like in accordance with the hydraulic system, a running condition, and the like, and not limited to the content exemplarily described.

(2) Operations

The hydraulic drive system according to Embodiment 3 is almost similar in operations to the hydraulic drive system 400 according to Embodiment 1 except for the following respects.

"Automatic Operation Under Area Limiting Control"

In a state in which the signal to validate the area limiting control over the hydraulic excavator 300 is transmitted from the control validation switch 96 to the controller 95 and an automatic operation is performed under the area limiting control, the controller 95A calculates the target flow rate of each actuator on the basis of the operation amounts of the boom 204, the arm 205, and the bucket 206 and the machine body operating state acquired from each pressure sensor and each stroke sensor, and also calculates the target pump flow rate of each hydraulic pump on the basis of the target flow rate of each actuator. At the same time, the controller 95A calculates a meter-in side current flow rate of each actuator from the differential pressure across the directional control valve acquired from the pressure sensors 80 and 81*b* (or pressure sensors 80 and 81*a*) attached to front and rear portions of the directional control valve and an opening area calculated on the basis of the opening area characteristics of the directional control valve with respect to the pilot pressure acting on the pressure command port of the directional control valve, and also calculates the current pump flow rate of each hydraulic pump on the basis of the current flow rate of each actuator. Furthermore, the controller 95A calculates the pump flow rate reduction rate α on the basis of the target pump flow rate and the current pump flow rate.

In the case of the pump flow rate reduction rate α=1, the controller 95 calculates the command electrical signal on the basis of the target flow rate of the main valve 33 and the differential pressure across the auxiliary flow controller 25 obtained from the pressure sensors 77 and 80 without correcting the target flow rate, and outputs the command to the pilot variable throttle 34 via the proportional solenoid pressure reducing valve 36.

In the case of the pump flow rate reduction rate α<1, the controller 95A calculates the flow rate correction ratio β, (corrected pump flow rate reduction rate) by multiplying the pump flow rate reduction rate α by the correction coefficient γ preset to each actuator. Furthermore, the controller 95A calculates the corrected target flow rate by multiplying the target flow rate of each actuator by the flow rate correction ratio R, and calculates a target command electrical signal on the basis of the corrected target flow rate of the main valve 33 and the differential pressure across the auxiliary flow controller 25 obtained from the pressure sensors 77 and 80. At the same time, the controller 95 determines whether the load pressure of the actuator subjected to the flow control is highest among the actuators subjected to the split flow from the pressure sensor output values.

In the case in which the load pressure of the actuator subjected to the flow control is not the highest load pressure among those of the actuators subjected to split flow, then the controller 95A outputs the target command electrical signal to the proportional solenoid pressure reducing valve 36, and the proportional solenoid pressure reducing valve 36 outputs an operation pressure of the hydraulic variable throttle valve 34 upon receiving the target command electrical signal.

In the case in which the load pressure of the actuator subjected to the flow control is highest among the actuators subjected to split flow, then the controller 95A does not output the target command electrical signal to the proportional solenoid pressure reducing valve 36, and the proportional solenoid pressure reducing valve 36 outputs a tank pressure as the operation pressure of the hydraulic variable throttle valve 34, thereby fully opening the main valve 33.

While the operation of the auxiliary flow controller 25 has been described above, the other auxiliary flow controller operate similarly.

According to Embodiment 3, the controller 95 corrects the pump flow rate reduction rate α by multiplying the pump flow rate reduction rate α by a correction coefficient γ preset to each of the plurality of hydraulic actuators 204*a*, 205*a*, 206*a*, and the like, and controls the plurality of auxiliary flow controllers 21 to 29 in such a manner that the supply flow rates to the plurality of directional control valves 7 to 12 and 14 to 16 from the hydraulic pumps 1, 2, and 3 are reduced in response to a pump flow rate reduction rate β corrected for each of the plurality of hydraulic actuators 204*a*, 205*a*, 206*a*, and the like in a case in which the control validation switch 96 issues an instruction to validate the area limiting control function and saturation occurs.

(3) Effects

Embodiment 3 configured as described so far can attain the following effects in addition to similar effects to those of Embodiment 1.

In a case in which the actual pump delivery flow rate is lower than the target pump flow rate and the state turns into the saturated state due to the horsepower control over the pump accompanying with an increase in the load pressure of each actuator, it is possible to enhance stability of the behavior of the actuator during saturation and to operate the actuator more stably by correcting the pump flow rate reduction rate $\alpha$ to be increased for the actuator (for example, swing motor) having a large inertial element, preferentially delivering the hydraulic fluid to the actuator, and thereby reducing a flow rate decreasing amount with respect to the saturation.

While the embodiments of the present invention have been described in detail, the present invention is not limited to the embodiments and encompasses various modifications. For example, the above embodiments have been described in detail for facilitating understanding the present invention, and the present invention is not always limited to the embodiments having all the configurations described above. Moreover, part of the configurations of the other embodiment can be added to the configurations of a certain embodiment, and part of the configurations of the certain embodiment can be deleted or can be replaced by part of the configurations of the other embodiment.

DESCRIPTION OF REFERENCE CHARACTERS

1: First hydraulic pump
1*a*: Flow control command pressure port (regulator)
1*b*: First hydraulic pump self-pressure port (regulator)
1*c*: Second hydraulic pump self-pressure port (regulator)
2: Second hydraulic pump
2*a*: Flow control command pressure port (regulator)
2*b*: First hydraulic pump self-pressure port (regulator)
2*c*: Second hydraulic pump self-pressure port (regulator)
3: Third hydraulic pump
3*a*: Flow control command pressure port (regulator)
3*b*: Third hydraulic pump self-pressure port (regulator)
4: Pilot pump
5: Hydraulic operating fluid tank
6: Right travel directional control valve
7: Bucket directional control valve
8: Second arm directional control valve
9: First boom directional control valve
10: Second boom directional control valve
11: First arm directional control valve
12: First attachment directional control valve
13: Left travel directional control valve
14: Swing directional control valve
15: Third boom directional control valve
16: Second attachment directional control valve
17: Merging valve
21: Bucket auxiliary flow controller
22: Second arm auxiliary flow controller
23: First boom auxiliary flow controller
24: Second boom auxiliary flow controller
25: First arm auxiliary flow controller
26: First attachment auxiliary flow controller
27: Swing auxiliary flow controller
28: Third boom auxiliary flow controller
29: Second attachment auxiliary flow controller
31: Main valve
31*a*: Valve body
31*b*: Feedback throttle (control variable throttle)
31*c*: First pressure chamber
31*d*: Second pressure chamber
31*e*: Third pressure chamber
32: Hydraulic variable throttle valve (pilot variable throttle)
32*a*: Pressure signal port
33: Main valve
33*a*: Valve body
33*b*: Feedback throttle (control variable throttle)
33*c*: First pressure chamber
33*d*: second pressure chamber
33*e*: Third pressure chamber
34: Hydraulic variable throttle valve (pilot variable throttle)
34*a*: Pressure signal port
35: Proportional solenoid pressure reducing valve
35*a*: Solenoid
36: Proportional solenoid pressure reducing valve
36*a*: Solenoid
41 to 62: Line
63: Pilot line
63*a*, 63*b*, 63*c*: Line
64: Pilot line
64*a*, 64*b*, 64*c*: Line
65 to 67: Line
71*a*, 71*b*, 72*a*, 72*b*, 73*a*, 73*b*: Pressure sensor
74, 75, 76: Stroke sensor
77, 78, 79*a*, 79*b*, 80, 81*a*, 81*b*: Pressure sensor
91*a*, 91*b*: Operation lever (operation lever device)
92*a*, 92*b*: Pilot valve
93: Selector valve unit (operation pressure generation valve device)
93*a*: Solenoid selector valve
94: Solenoid proportional valve unit (operation pressure generation valve device)
94*a*: Proportional solenoid pressure reducing valve
95, 95A: Controller
95*a*: Input section
95*b*: Control validation determination section
95*c*: Machine body posture computing section
95*d*: Demanded flow rate computing section
95*e*: Target flow rate computing section
95*f*: Corrected target flow rate computing section
95*g*: Target pump flow rate computing section
95*h*: Pump flow rate reduction rate computing section
95*i*: Actuator flow rate computing section
95*j*: Current pump flow rate computing section
95*k*: Output section
95*l*: Flow rate correction ratio computing section
95*m*: Pressure state determination section
96: Control validation switch
97 to 101: Line
111, 112: Pressure sensor
201: Travel structure
202: Swing structure
203: Work device
204: Boom
204*a*: Boom cylinder (hydraulic actuator)
205: Arm
205*a*: Arm cylinder (hydraulic actuator)
206: Bucket
206*a*: Bucket cylinder (hydraulic actuator)
207: Cabin
208: Machine room
209: Counterweight
210: Control valve

300: Hydraulic excavator (work machine)

400, 400A: hydraulic drive system

The invention claimed is:

1. A work machine, comprising:

a travel structure;

a swing structure swingably attached onto the travel structure;

a work device attached to the swing structure;

a plurality of hydraulic actuators driving the swing structure or the work device;

hydraulic pumps;

regulators exercising horsepower control over the hydraulic pumps in response to load pressures of the plurality of hydraulic actuators;

a plurality of directional control valves connected to delivery lines of the hydraulic pumps in parallel and regulating supply flow rates to the plurality of hydraulic actuators from the hydraulic pumps;

operation lever devices for issuing instructions on operations of the plurality of hydraulic actuators;

a pilot pump;

operation pressure generation valve devices reducing a delivery pressure of the pilot pump in response to operation instruction amounts from the operation lever devices, and outputting the reduced delivery pressure as operation pressures of the plurality of directional control valves;

a control validation switch for issuing an instruction to validate or invalidate an area limiting control function to prevent entry of the work device into a preset area; and a controller that controls the operation pressure generation valve devices in such a manner as to output the operation pressures in response to the operation instruction amounts from the operation lever devices in a case in which the control validation switch issues an instruction to invalidate the area limiting control function, and that controls the operation pressure generation valve devices in such a manner as to correct the operation pressures in response to the operation instruction amounts from the operation lever devices and to output the corrected operation pressures in a case in which the control validation switch issues an instruction to validate the area limiting control function, wherein the work machine includes a plurality of auxiliary flow controllers that are connected to upstream of the plurality of directional control valves and that can limit supply flow rates to the plurality of directional control valves from the hydraulic pumps, and the controller is configured to, in the case in which the control validation switch issues an instruction to invalidate the area limiting control function, control the plurality of auxiliary flow controllers in such a manner that the supply flow rates to the plurality of directional control valves from the hydraulic pumps fluctuate in response to load fluctuations of the plurality of hydraulic actuators, and in the case in which the control validation switch issues an instruction to validate the area limiting control function, control the plurality of auxiliary flow controllers in such a manner that the supply flow rates to the plurality of directional control valves from the hydraulic pumps do not fluctuate in response to the load fluctuations of the plurality of hydraulic actuators, and control the plurality of auxiliary flow controllers in such a manner that the supply flow rates to the plurality of directional control valves from the hydraulic pumps are reduced in response to a pump flow rate reduction rate that is a ratio of a current delivery flow rate of each of the hydraulic pumps to a target delivery flow rate of each of the hydraulic pumps at a time of occurrence of saturation indicating that the current delivery flow rate of each of the hydraulic pumps is reduced to be lower than the target delivery flow rate of each of the hydraulic pumps due to the horsepower control.

2. The work machine according to claim 1, wherein the plurality of auxiliary flow controllers include sheet-shaped main valves forming auxiliary variable throttles, control variable throttles changing opening areas in response to movement amounts of sheet valve bodies of the main valves, pilot lines determining movement amounts of the sheet valve bodies in response to pass-through flow rates, and pilot variable throttles disposed on the pilot lines and changing opening amounts in response to commands from the controller, and the controller is configured to, in the case in which the control validation switch issues an instruction to invalidate the area limiting control function, control the opening amounts of the pilot variable throttles in such a manner that the pass-through flow rates of the main valves fluctuate in response to the load fluctuations of the plurality of hydraulic actuators, and in the case in which the control validation switch issues an instruction to validate the area limiting control function, control the opening amounts of the pilot variable throttles in such a manner that the pass-through flow rates of the main valves do not fluctuate in response to the load fluctuations of the plurality of hydraulic actuators, and control the opening amounts of the pilot variable throttles in such a manner that the pass-through flow rates of the main valves are reduced in response to the pump flow rate reduction rate at the time of occurrence of the saturation.

3. The work machine according to claim 2, the pilot variable throttles being each configured with a hydraulic variable throttle valve, the work machine further comprising:

first pressure sensors provided at delivery lines of the hydraulic pumps;

second pressure sensors provided at hydraulic lines connecting the plurality of directional control valves to the main valves; and proportional solenoid pressure reducing valves reducing the delivery pressure of the pilot pump in response to a command from the controller and outputting the reduced delivery pressure as the operation pressures of the hydraulic variable throttle valves, wherein the controller is configured to, in the case in which the control validation switch issues an instruction to invalidate the area limiting control function, calculate target opening amounts of the hydraulic variable throttle valves on a basis of the operation instruction amounts from the operation lever devices, calculate current opening amounts of the hydraulic variable throttle valves on a basis of opening characteristics of the hydraulic variable throttle valves and operation pressures of the hydraulic variable throttle valves, and control opening amounts of the hydraulic variable throttle valves via the proportional solenoid pressure reducing valves in such a manner as to reduce differences between the target opening amounts and the current opening amounts, and in the case in which the control validation switch issues an instruction to validate the area limiting control function, calculate target pass-through flow rates of the main valves on a basis of the operation instruction amounts from the operation lever devices, calculate current pass-through flow rates of the main valves on a basis of differential pressures across the main valves detected by the first pressure sensors and the second pressure sensors and the current opening amounts of the main valves with respect to the operation pressures outputted from the proportional solenoid pressure reducing valves, and control the opening amounts of the hydraulic variable throttle valves via the proportional solenoid pressure reducing valves in such a manner as to reduce differences between the target pass-through flow rates and the current pass-through flow rates.

4. The work machine according to claim 2, further comprising:

a differential-pressure-across-valve sensor that detects the differential pressures across the plurality of directional control valves, the work machine calculating the current opening amounts of the plurality of directional control valves on a basis of the opening characteristics of the plurality of directional control valves and the operation pressures outputted from the operation pressure generation valve devices, wherein the controller is configured to calculate current supply flow rates to the plurality of actuators from the plurality of directional control valves on a basis of the differential pressures across the plurality of directional control valves detected by the differential-pressure-across-valve sensor and the current opening amounts of the plurality of the directional control valves, and calculate the current delivery flow rates of the hydraulic pumps by adding up the current supply flow rates to the plurality of actuators from the plurality of directional control valves.

5. The work machine according to claim 4, wherein the differential-pressure-across-valve sensor is configured with the second pressure sensors provided at the hydraulic lines connecting the plurality of directional control valves to the main valves; and third pressure sensors provided at hydraulic lines connecting hydraulic operating fluid supply-side ports of the plurality of hydraulic actuators to the plurality of directional control valves.

6. The work machine according to claim 4, wherein the differential-pressure-across-valve sensor is configured with fourth pressure sensors provided at hydraulic lines connecting hydraulic operating fluid discharge-side ports of the plurality of hydraulic actuators to the plurality of directional control valves; and fifth pressure sensors provided at hydraulic lines connecting the plurality of directional control valves to a hydraulic operating fluid tank.

7. The work machine according to claim 1, wherein the controller is configured to, in a case in which the control validation switch issues an instruction to validate the area limiting control function and saturation occurs, correct the pump flow rate reduction rate by multiplying the pump flow rate reduction rate by a correction coefficient preset to each of the plurality of hydraulic actuators, and control the plurality of auxiliary flow controllers in such a manner that the supply flow rates to the plurality of directional control valves from the hydraulic pumps are reduced in response to a pump flow rate reduction rate corrected for each of the plurality of hydraulic actuators.

* * * * *